US005156386A

United States Patent [19]

Kitajima et al.

[11] Patent Number: 5,156,386

[45] Date of Patent: Oct. 20, 1992

[54] ORIGINAL DOCUMENT FEEDER

[75] Inventors: Tadayuki Kitajima, Yokohama; Makoto Kitahara, Tokyo, both of Japan

[73] Assignee: Canon Kabushiki Kaisha, Tokyo, Japan

[21] Appl. No.: 820,805

[22] Filed: Jan. 15, 1992

Related U.S. Application Data

[63] Continuation of Ser. No. 746,183, Aug. 15, 1991, abandoned, which is a continuation of Ser. No. 473,108, Jan. 30, 1990, abandoned, which is a continuation of Ser. No. 905,935, Sep. 10, 1986, abandoned.

[30] Foreign Application Priority Data

Sep. 13, 1985 [JP] Japan ..... 60-203030

[51] Int. Cl.[5] ..... B65H 3/44

[52] U.S. Cl. ..... 271/3.1; 271/9; 271/291; 271/301; 271/902

[58] Field of Search ..... 271/3, 3.1, 9, 186, 271/291, 301, 902

[56] References Cited

U.S. PATENT DOCUMENTS

| | | | |
|---|---|---|---|
| Re. 23,641 | 4/1953 | Andrew | 270/95 |
| 4,157,822 | 6/1979 | Miller | 271/3/ |
| 4,248,528 | 2/1981 | Sahay | 355/14 R |
| 4,295,733 | 10/1981 | Janssen | 355/14 R X |
| 4,319,833 | 3/1982 | Hidding | 271/3.1 X |
| 4,330,197 | 5/1982 | Smith | 355/23 X |
| 4,419,007 | 12/1983 | Kingsley | 271/3.1 X |
| 4,456,236 | 6/1984 | Buddendeck | 271/291 X |
| 4,744,553 | 5/1988 | Hirose | 271/3.1 |
| 4,769,674 | 9/1988 | Kitajima et al. | 355/14 SH |
| 4,849,796 | 7/1989 | Murakami | 355/206 |

*Primary Examiner*—Richard A. Schacher

*Attorney, Agent, or Firm*—Fitzpatrick, Cella, Harper & Scinto

[57] ABSTRACT

An invention document feeder is provided with a first sheet path for guiding a document from stacker to below after inversion, a second sheet path branched from the first sheet path in a switchback fashion for guiding the sheet to a process position, and a third sheet path branched from the first sheet path in a switchback fashion for discharging the sheet, discharged from the process position, to a receiver after inversion.

32 Claims, 23 Drawing Sheets

Fig. 7 (1)
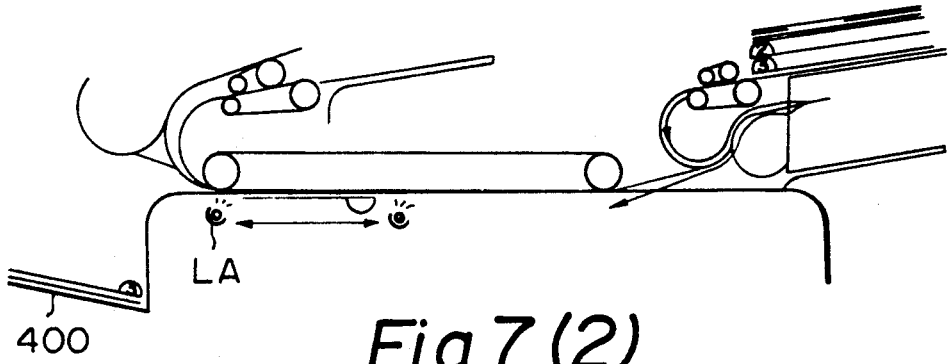
Fig. 7 (2)
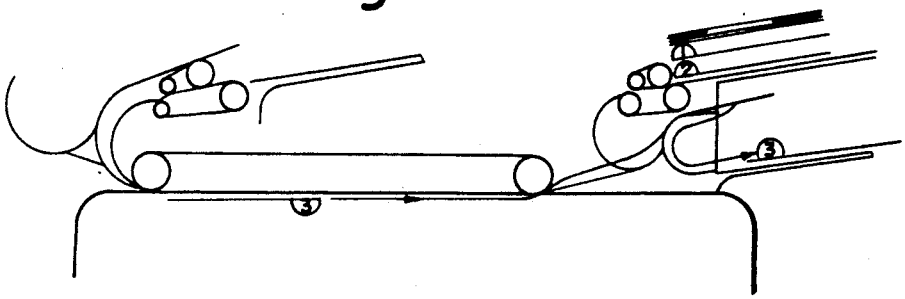
Fig. 7 (3)
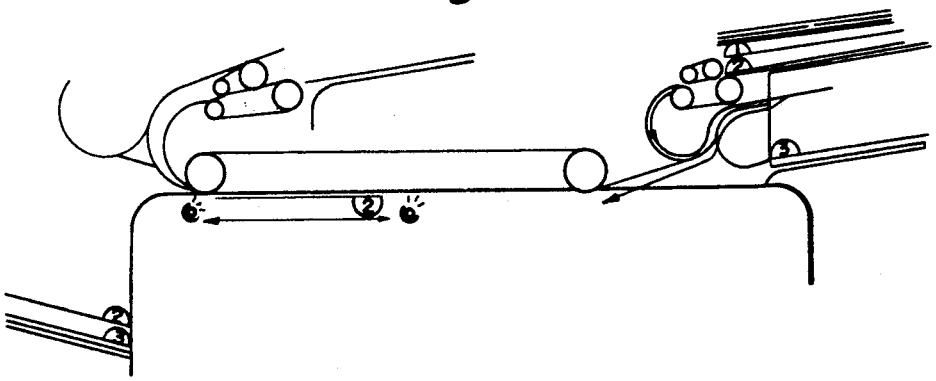

ORIGINAL DOCUMENT FEEDER

This application is a continuation of application Ser. No. 07/746,183, filed Aug. 15, 1991, which is a continuation of application Ser. No. 07/473,108, filed Jan. 30, 1990, which is a continuation of application Ser. No. 06/905,935 filed on Sep. 10, 1986, now abandoned.

BACKGROUND OF THE INVENTION

1. Field of the Invention

The present invention relates to an original document feeder to be equipped in an image forming apparatus such as a copying machine, and, in particular to such original document feeder for feeding original document stacked for example on a stacker tray to a predetermined process unit, and further guiding said original documents, after processing, to an original receiver.

2. Related Background Art

In the conventional original document feeder for use in a copying apparatus, a user cannot use the feeder until a preceding user completes processing of the original documents. In fact the users have to wait in line until the preceding user completes the processing. However such situation is naturally inefficient and wasteful in time.

For this reason there has been proposed an automatic original document feeder allowing, even during the processing of a set of documents, to set another set of documents, thereby capable of processing the new set of documents in succession when the processing for the preceding set of documents is completed.

For example the U.S. Pat. No. 4,248,529 discloses an automatic document handling apparatus comprising plural original document trays capable of stacking plural documents, a document feed roller for feeding the documents from the document tray one by one, copying means for copying the original document fed by said original document feed roller, control means for controlling the feeding of the original documents from the trays in such a manner that the document feeding from a reserved tray is started after a last document is fed from a tray, and a document receiving tray for receiving the thus copied original documents.

Also the Japanese Patent Laid-open No. 121136/1979 discloses a copying apparatus equipped with a mechanism for automatically feeding original documents to an exposure position, which comprises generating an electrical signal indicating a change in the copying conditions, when all the original documents constituting a predetermined set have been fed from a document stacking tray and the original documents of another set are to be fed.

The above-explained conventional apparatus functions in the following manner. An original document from a document stacking tray is supplied, from an end of a platen glass and along a path formed above said platen glass, to the other end thereof. The document is then inverted by a guide member provided at said other end, and is guided to a predetermined position on the platen glass by a conveyor belt, from said other end. After the exposure, the document is discharged by the conveyor belt to the first-mentioned side of the platen glass.

However, such structure is associated with a drawback of requiring a long time for guiding the document to the predetermined position on the platen glass, regardless of the size of the original document.

SUMMARY OF THE INVENTION

In consideration of the foregoing, the object of the present invention is to provide an original document feeder capable of setting one or more blocks of original documents on a single document stacking unit, wherein a block means a group of documents requiring the same copying conditions, and handling said documents automatically and continuously with copying conditions required for each block of documents.

The original document feeder of the present invention is characterized by a fact that each document set on the original document stacking unit is guided to a process unit from the entrance side thereof, then discharged from said entrance side and stacked on a document receiving unit, and by the presence of a path guiding to said receiving unit bypassing the process unit.

In this manner, the present invention allows to set blocks of original documents on a single document stacking unit, and to effect the handling process continuously and automatically with process conditions required for each block of documents and to discharge the documents after processing, thereby enabling efficient processing of plural blocks of documents.

Also a further improvement in the efficiency can be achieved since the original documents are separated from the bottom of the stack of documents, so that another block of document can be placed on top of documents which are currently being processed.

Besides a high-speed setting of original document is rendered possible since each document is introduced, with inversion, to the process unit from the entrance side thereof.

Furthermore, the presence of a path leading to document receiver means and bypassing the process unit allows to discharge a partition sheet without going through the process unit, in case that such partition sheet is used for separating blocks of the original documents.

Furthermore, the presence of a document feeder, capable of recycle document transportation, at the other side, opposite to the entrance, of the process unit enables recycle transportation of the original document, thus allowing to sort plural copies without the use of a sorter.

Furthermore, a path for guiding the document to the process unit with inversion, provided in said document feeder capable of recycle transportation enables a reserved copying operation of two-sided original documents.

DESCRIPTION OF THE PREFERRED EMBODIMENTS

FIGS. 1 to 6 illustrate an embodiment of the present invention mounted on a main copying apparatus and combined with a known circulating document feeder.

Figure 1:
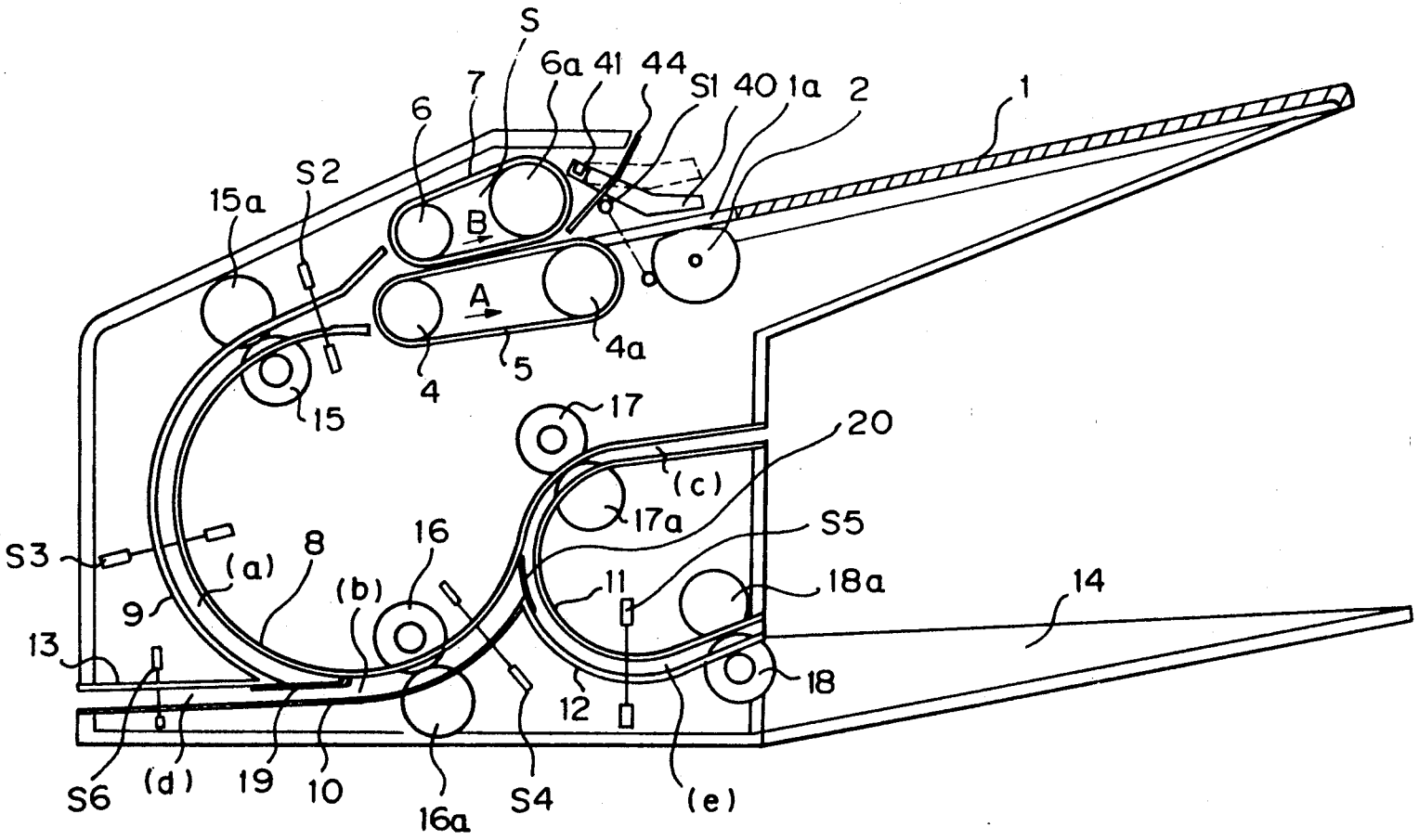
FIG. 1 is a cross-sectional view of an embodiment of the present invention.

FIG. 1 is a cross-sectional view of an embodiment of the present invention, wherein a stacker tray 1, for stacking the original documents thereon, is inclined downwards in the document feeding direction so that the exit side is positioned lower. Thus, the original documents are aligned at said exit side.

A semi-circular roller 2, for feeding the original documents to a downstream separating unit, is so controlled as to stop with the notched portion thereof upwards when no document is present in the stacking tray.

Feed rollers 4, 4*a* rotate a feed belt 5 in a direction indicated by an arrow A to feed the document on the tray 1. Separating rollers 6, 6*a* rotate a separating belt 7 in a direction indicated by an arrow B to separate, in cooperation with the feed belt 5, the lowermost one of the documents stacked on the tray 1. Said feed belt 5 and the separating belt 7 constitute a separation-feed unit S.

A first sheet path is composed of a portion (a) defined by guide plates 8, 9, a portion (b) defined by guide plates 8, 10, and a portion (c) defined by guide plates 8, 11, and is adapted to invert and hold the document separated in said separation-feed unit S.

A second sheet path (d) is formed by guide plates 10, 13, and is branched in a switchback fashion from the portion (b) of the first sheet path, for guiding the document, from the first sheet path, to a downstream process unit.

A third sheet path (e) is composed of guide plates 11, 12, and is branched in a switchback fashion from the portion (c) of the first sheet path, for guiding the document from the first sheet path toward a discharged sheet tray 14, which is positioned below the extention of the third sheet path (e).

Transport rollers 15, 15*a*, 16, 16*a*, 17, 17*a*, 18 and 18*a* are provided to transport the document in the portions (a), (b) and (c) of the first sheet path and the third sheet path (e).

Flexible deflector plates 19, 20 are respectively adhered onto the guide plates 13, 12 in such a manner that the front ends thereof are in contact with the guide plate 8. The front end of a document passing through the path portion (a) is capable of pushing up said deflector plate 19, and the front end of a document passing through the path portion (b) is capable of pushing up said deflector plate 20. On the other hand, a document proceeding from the path (b) or (c) to (d) or (e) is securely guided thereto since the front end of the deflector plate 19 or 20 is maintained in contact with the guide plate 8. Said deflector plates 19, 20 is composed of a flexible sheet such as a Mylar film or a thin stainless steel plate.

A first sheet sensor S1, positioned at the front end side of the document stacking tray 1, detects the presence of documents on said tray 1. A second sheet sensor S2 is provided in the path portion (a) between the separation-feed unit S and transport rollers 15, 15*a*. A third sheet sensor S3 is provided in the path portion (a) between the transport rollers 15, 15*a* and the transport rollers 16, 16*a*. A fourth sheet sensor S4 is provided in the path portion (b) between the transport rollers 16, 16*a* and the transport rollers 17, 17*a*. A fifth sheet sensor S5 is provided in the third sheet path (e) between the transport rollers 17, 17*a* and the transport rollers 18, 18*a*. A sixth sheet sensor S6 is provided in the second sheet path (d). The second to sixth sheet sensors S2–S6 detect the front or rear end of a passing document. Also the second sheet sensor S2 is used for detecting the partition between blocks of documents, by means of a partition sheet as will be explained later.

A weight member 40, rotatable about a shaft 41, is positioned above an aperture 1*a* provided in the stacking tray 1. Said weight member 40 is normally biased to an upper escape position, indicated by broken lines in FIGS. 1 and 4, by means of a spring 42 shown in FIG. 4, but is lowered against the function of the spring when a solenoid 43 is energized to come in contact with the upper face of a document positioned above the semi-circular roller 2, thus giving a suitable pressure onto said document. The pressure applied by said weight member 40 onto the stacked sheets P stabilizes and ensure the feeding of the lowermost document toward the unit S by the semi-circular roller 2.

Figure 5:
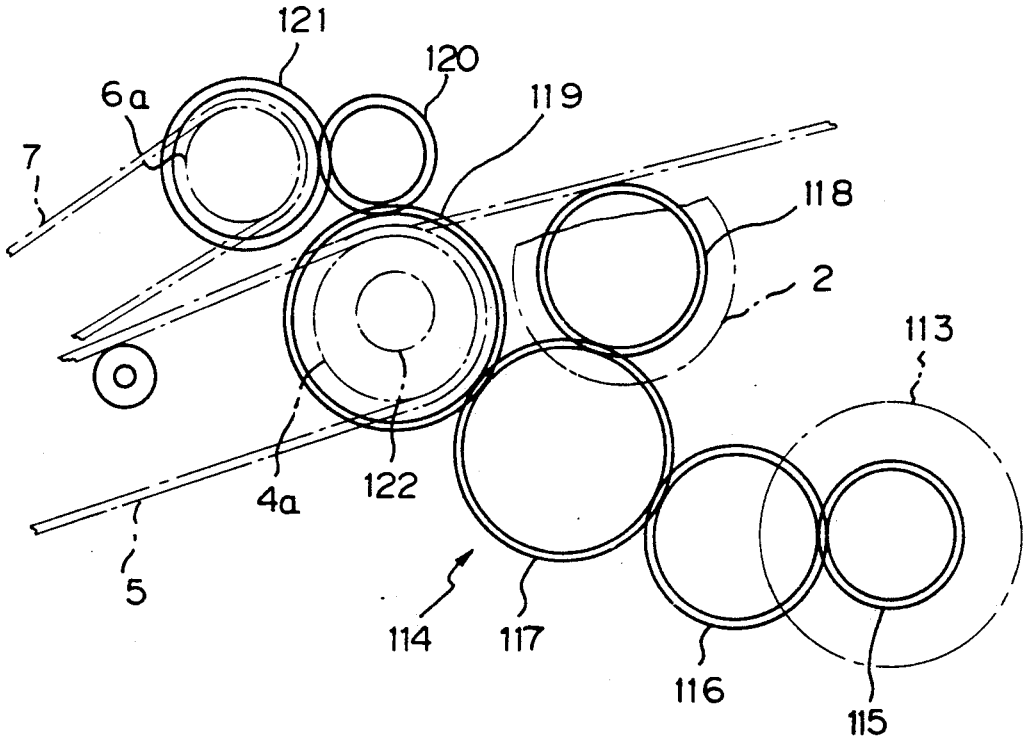
FIG. 5 is a detailed view of a separator driving system.

Now reference is made to FIG. 5 for explaining the function of the separation-feed unit S.

FIG. 5 illustrates the drive system of said unit S, wherein a gear train 114 is composed in the following manner. A gear 115 fixed on a shaft of a driving motor 115 meshes with a gear 117 through an intermediate gear 116. Said gear 117 meshes with a gear 118 fixed on the shaft of the semi-circular roller 2 and with a gear 119 for driving the drive pulley 4*a* driving the feed belt 5. The gear 119 also drives, through an intermediate gear 120, a gear 121 fixed on the shaft of the pulley 6*a* for driving the separating belt 7.

Between the gear 119 and the pulley 4*a* for driving the feed belt 5 there is provided a known one-directional clutch 122 to allow rotation in the forward (anticlockwise) direction.

Figure 6:
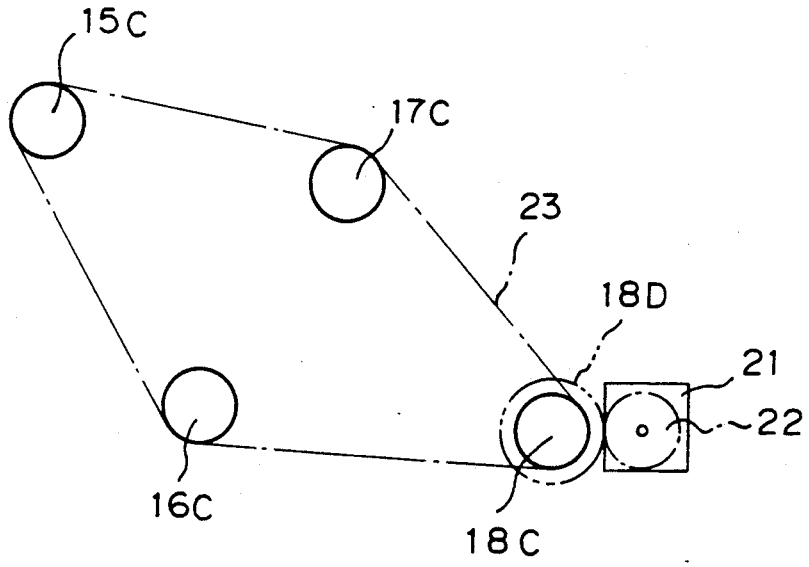
FIG. 6 is a detailed view of a transport driving system.

Now reference is made to FIG. 6 for explaining the drive unit, wherein provided are a transport motor 21 capable of rotation in the forward and reverse directions; a motor gear 22 mounted on the shaft thereof; a gear 18D mounted on the shaft of the transport roller 18 and meshing with the motor gear 22; a pulley 18C mounted on said shaft; pulleys 15C, 16C and 17C respectively mounted on the shafts of the transport rollers 15, 16, 17; and a timing belt 23 placed to run around said pulleys 15C, 16C, 17C and 18C, whereby the rotation of the motor 22 is transmitted to said transport rollers 15–18.

Figure 2:
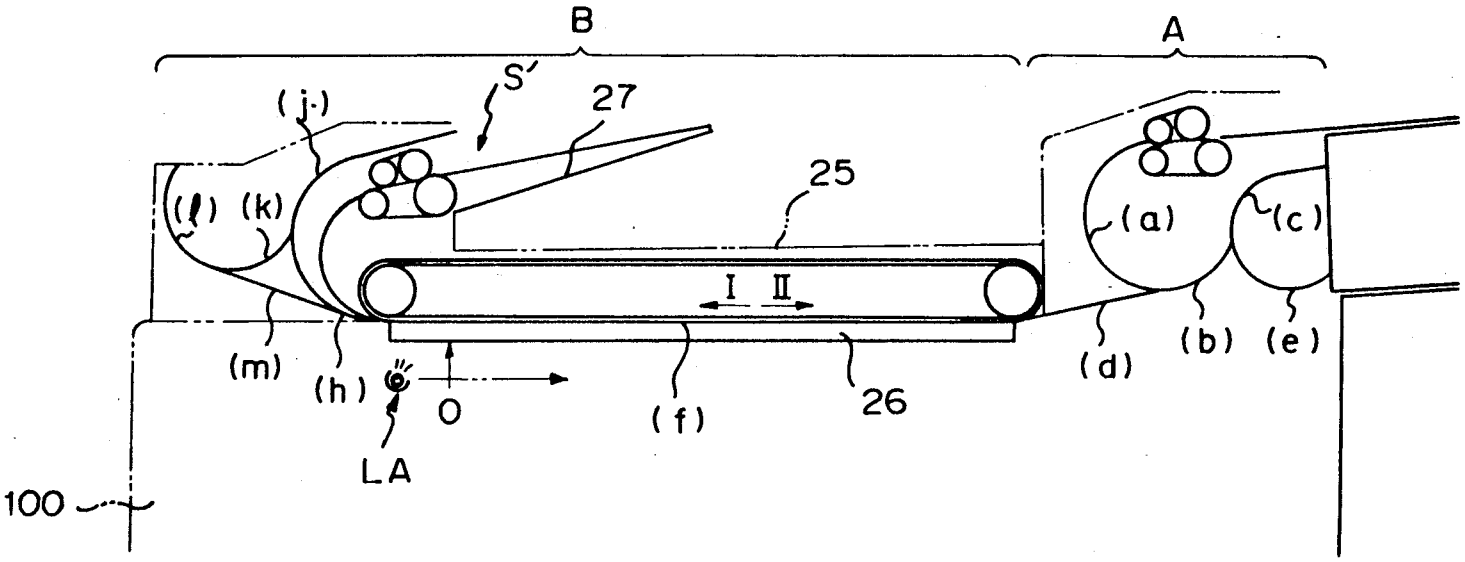
FIG. 2 is a cross-sectional view in which an embodiment of the present invention is combined with a main apparatus and a circulating document feeder.

Now reference is made to FIG. 2 for explaining the function of the present embodiment, wherein A indicates the original document feeder constituting an embodiment of the present invention, while B indicates a circulating document feeder, and 100 indicates the main body of a copying apparatus.

Figure 3:
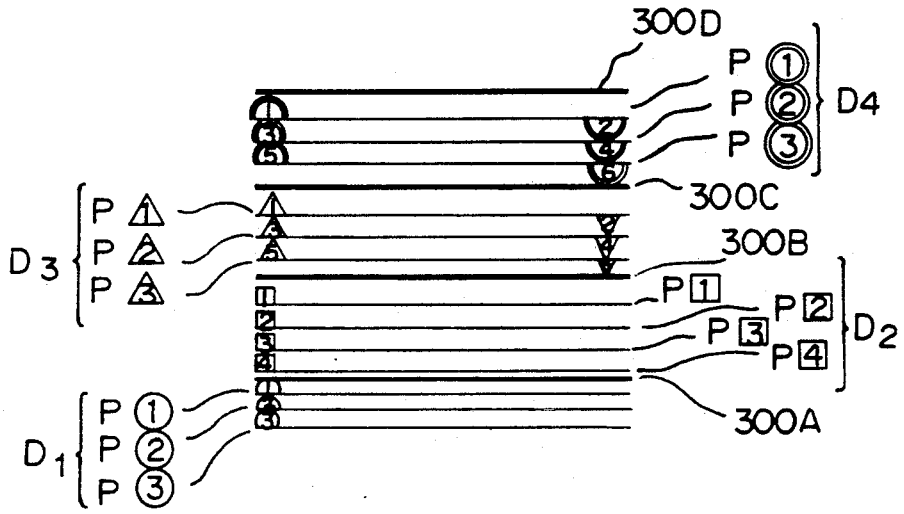
FIG. 3 is a detailed view of original document blocks.

As a specific example, there will be explained a case of obtaining one-sided or two-sided copies from original documents shown in FIG. 3, composed of a block of three one-sided original documents of pages (1)–(3), a block of four one-sided original documents of pages [1]–[4], and two blocks of three two-sided original documents of pages ⊙–⊙ and ⊙–⊙.

Between the blocks of documents there are provided partition sheets 300A–300D for indicating the boundaries of the blocks. The upper face of said sheet bears a marking, indicating the partition of blocks, in the transversal direction and in a position corresponding to the sensor S2. Thus said sensor S2 detects the partition between the blocks when said partition sheet 300 passes through the path portion (a).

The one-sided original documents are stacked with the image-bearing faces upwards and starting from the lowest page number at the top, while the two-sided original documents are stacked in the order of pages with the page one at the top. The blocks of the original documents in this state are placed on the tray 1 in the unit A, and are well inserted between the tray 1 and the lifted weight member 40 until the front ends of the documents are in contact with a defining plate 44. Then the copying modes for the document blocks D1–D4 are preset in the main apparatus 100 by means of unrepresented keys of an operation unit thereof. In the following the operation will be explained for each block.

A. Process for the block D1 of one-sided documents (see FIGS. 7(1) to 7(11))

(1) After the original documents are set, an unrepresented copy start key of the copying machine 100 is depressed.

Figure 4:
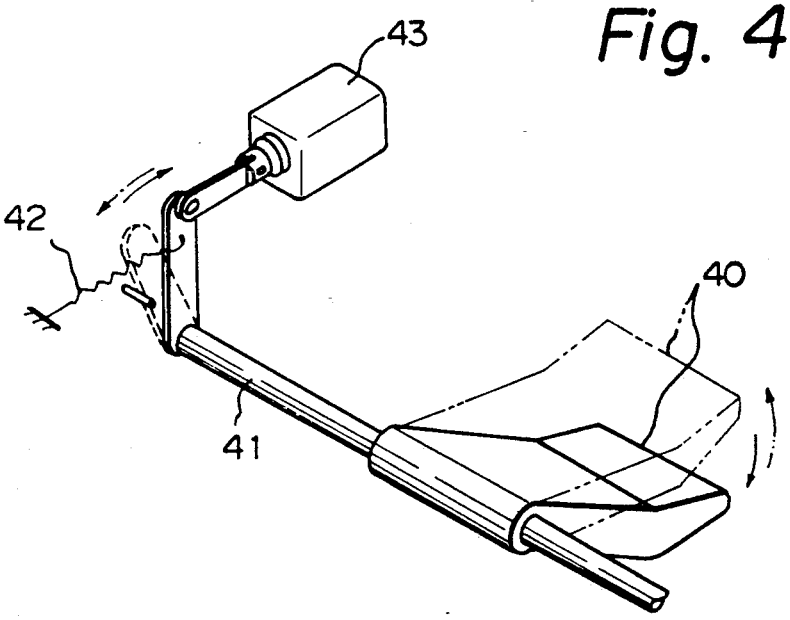
FIG. 4 is a detailed view of a weight element.

(2) In response to a copy start signal, the solenoid 43 in FIG. 4 is energized to lower the weight member 40, thus pressing the stacked documents downwards.

(3) Subsequently the semi-circular roller 2 and the separation-feed unit S are activated to separate the lowermost sheet on the tray 1, i.e. page (3) of the document block D1 and guide the same into the portion (a) of the first sheet path.

(4) The document of the page (3) in the portion (a) of the first sheet path is subjected to a front end detection by the second sheet sensor S2, and is then stopped by the nip of the transport rollers 15, 15*a* which are then stopped. Said rollers 15, 15*a* are activated after the lapse of a predetermined time T1 from the front end detection of the document by the sheet sensor S2. During said lapse there is created a predetermined loop in the document between the separation-feed unit S and the rollers 15, 15*a*.

(5) When the transport rollers 15, 15*a* are activated, the semi-circular roller 2 and the separation-feed unit S are deactivated. Also the solenoid 43 is deactivated whereby the weight member 40 is lifted and separated from the documents stacked on the tray 1. Even after the roller 2 and the unit S are deactivated, the document of page (3) continue to advance in the portion (a) of the first sheet path by the rotation of the transport rollers 15, 15*a*.

(6) Subsequently the front end of said document pushes away the deflector plate 19 and enters the nip between the tranport rollers 16, 16*a*. It then pushes away the deflector 20 and enters the nip between the transport rollers 17, 17*a*. In this manner the document advances in the order of portions (a), (b) and (c) in the first sheet path.

(7) After the lapse of a predetermined time T2 from the detection of the rear end of the document by the sheet sensor S3, the rotation of the transport rollers is reversed. Simultaneously a full-width conveyor belt 25 of the circulating document feeder B starts to rotate in a direction I. Before the expiration of said time T2, the rear end of the document passes through the deflector 19 and reaches a position in front of the rollers 16, 16*a*.

(8) By the above-mentioned reversing of the rollers 16, 16*a*, the document of page (3) in the first sheet path is transported in a switchback fashion, then enters the second sheet path (d) and reaches the nip between the conveyor belt 25 and a platen 26 (portion (f)).

(9) The full-width conveyor belt 25 is stopped after a predetermined count of clock signals CL1 from the front end detection of the document by the sensor S6. At the moment of said stopping, the front end of the document of page (3), transported onto a platen glass 26, reaches the position of a predetermined reference line 0 (FIG. 2). In this state the page (3) is placed on the platen glass 26, with the image bearing face downwards.

(10) Then, in response to a stop signal for the full-width conveyor belt 25, an optical system LA of the copying machine 100 starts to move in a direction indicated by a double-dot chain line to effect an exposure process for the original document of page (3) set on the platen glass 26. The copying mode in this state is determined by and executed according to data previously entered through the operation unit. In the present example it is assumed that the documents of the block D1 are subjected to a copy process for obtaining one-sided copies from one-sided originals. In such mode, the image of page (3) of the original document is formed on a first face of a copy sheet P, which is discharged onto a copy tray 400, with the image bearing face upwards.

In the following there will be separately explained a case of forming a copy and another case of forming plural copies.

Figure 7:
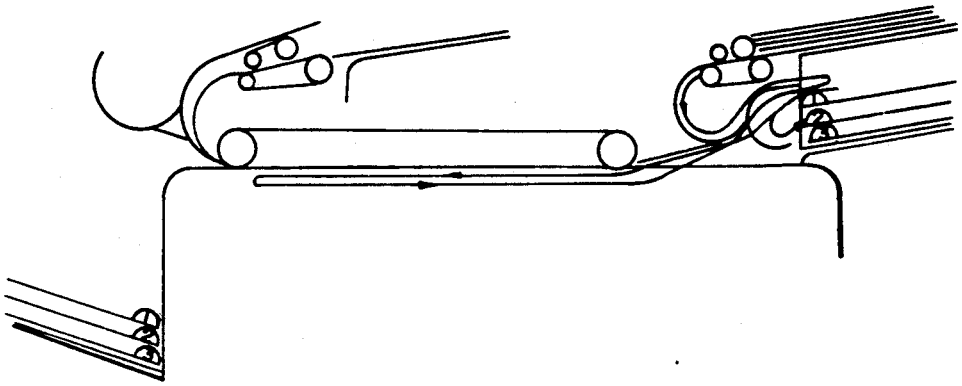
FIGS. 7(1) to 7(48) are views showing various steps of function.
Figure 7:
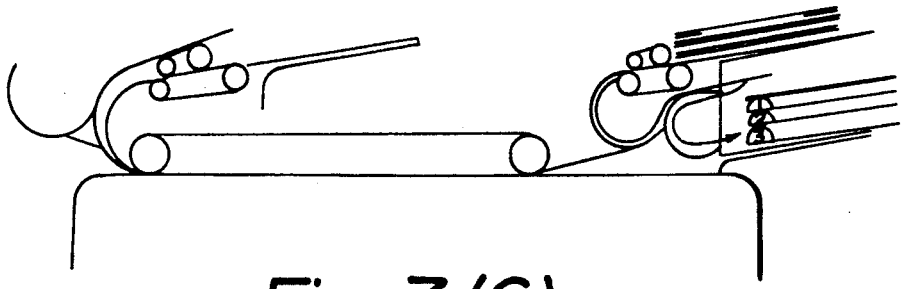
Figure 7:
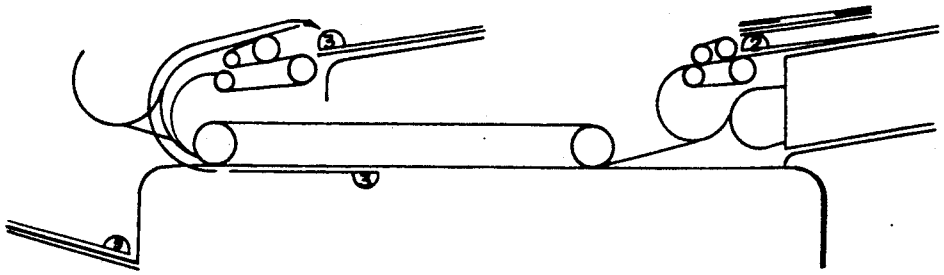
Figure 7:
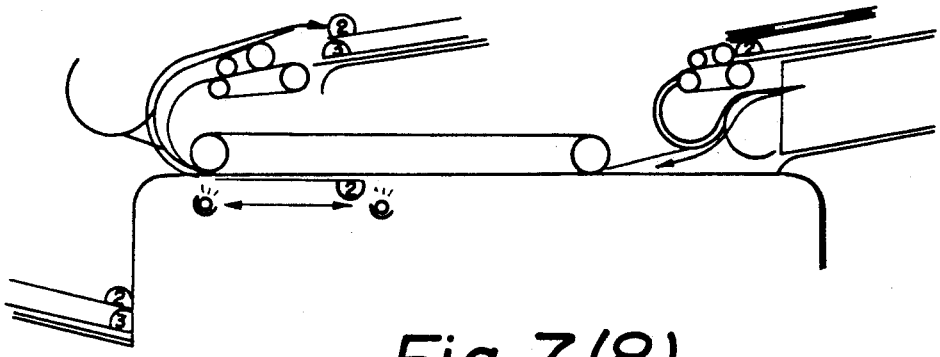
Figure 7:
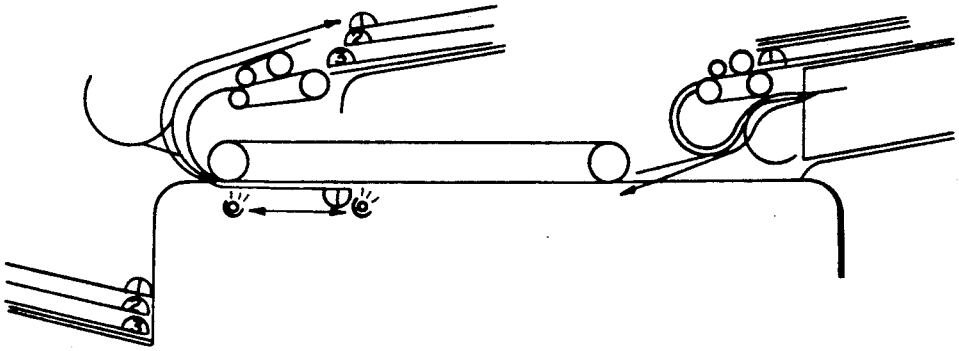
Figure 7:
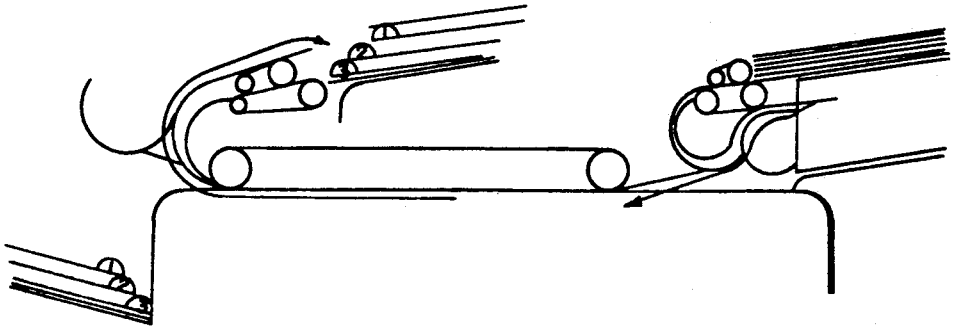
Figure 7:
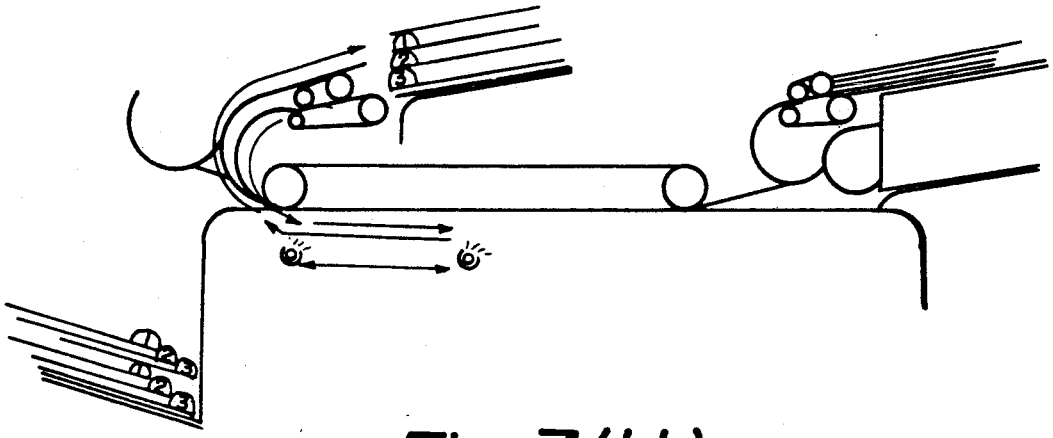
Figure 7:
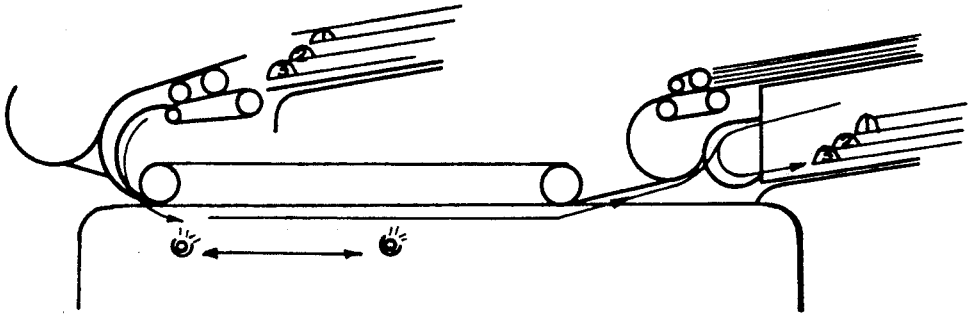
Figure 7:
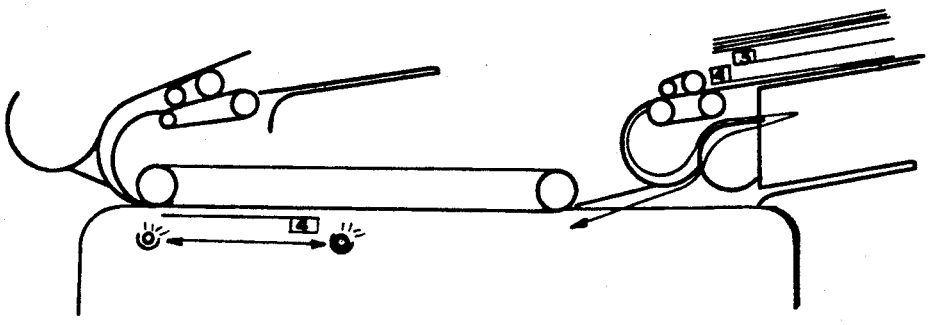
Figure 7:
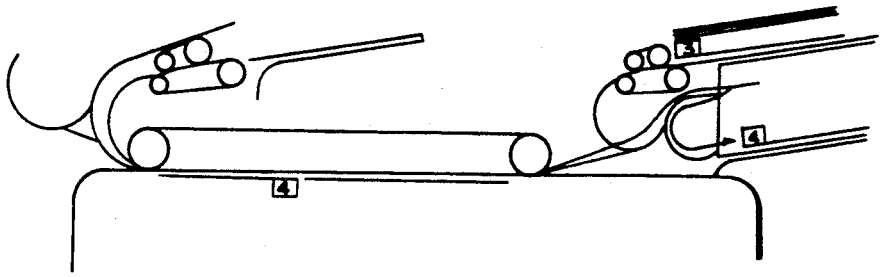
Figure 7:
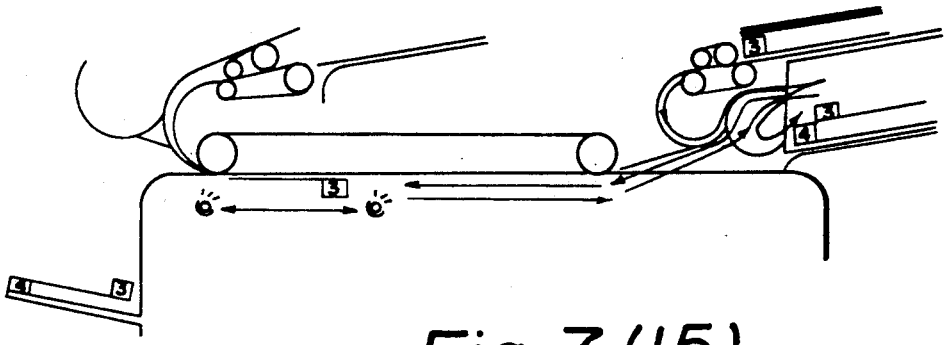
Figure 7:
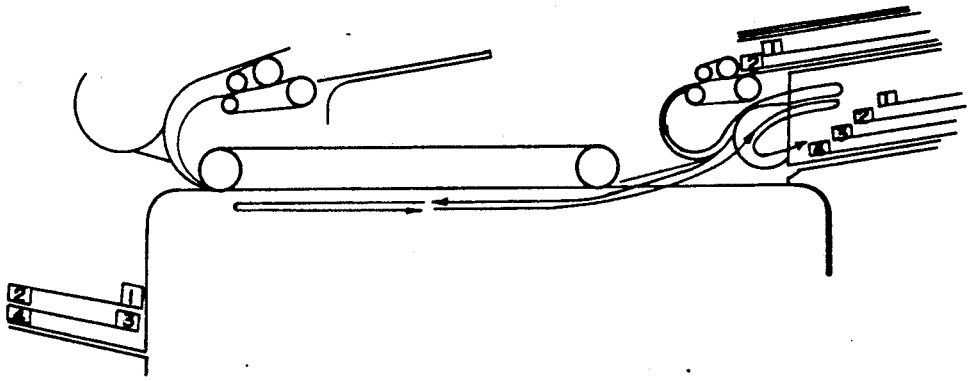
Figure 7:
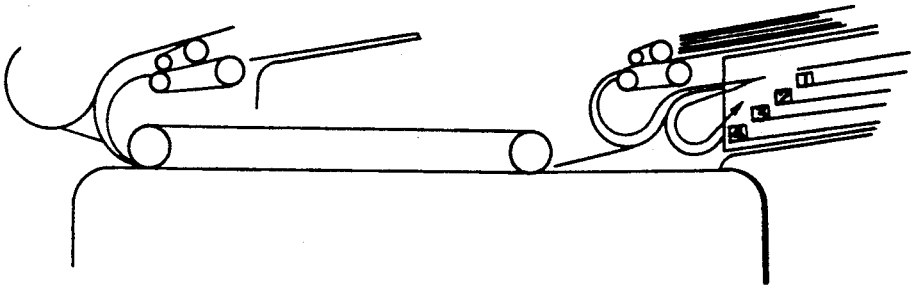
Figure 7:
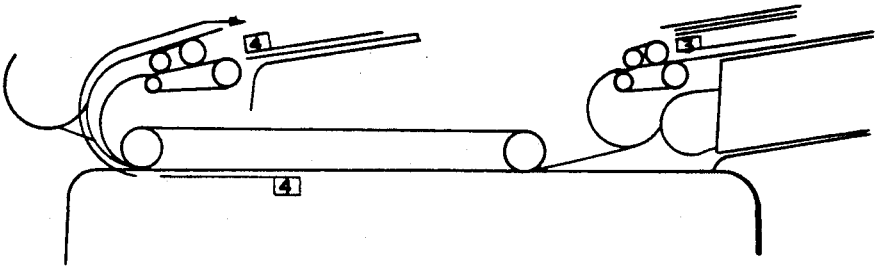
Figure 7:
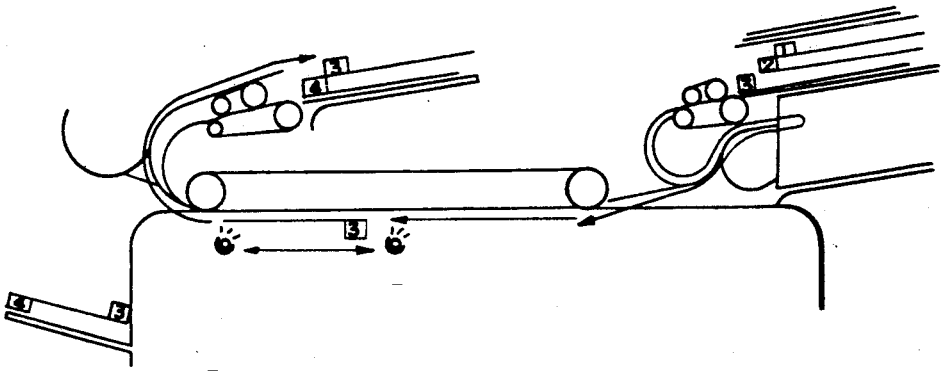
Figure 7:
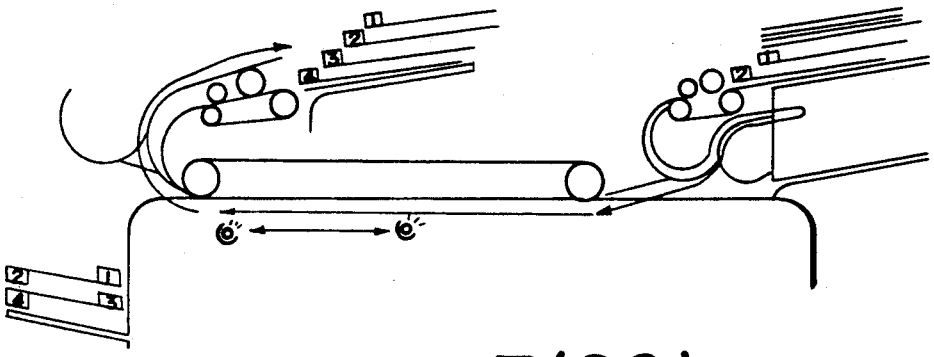
Figure 7:
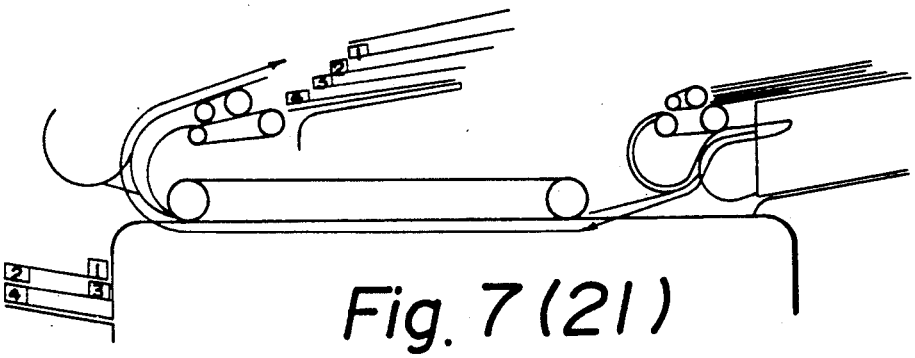
Figure 7:
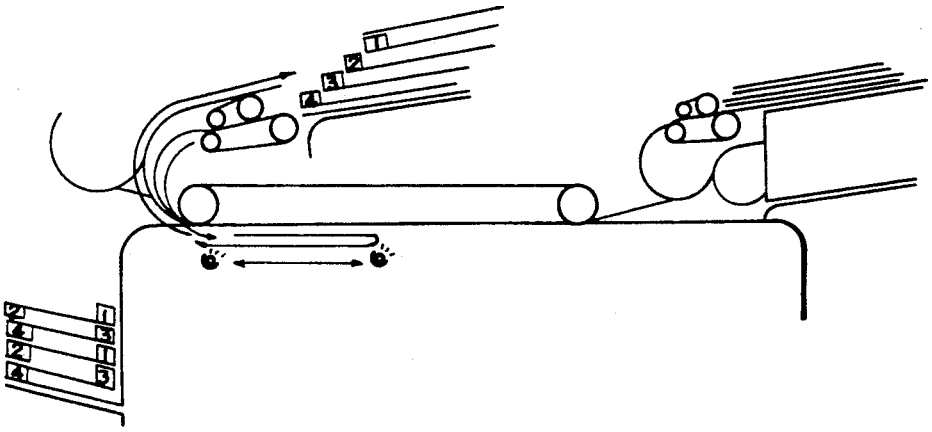
Figure 7:
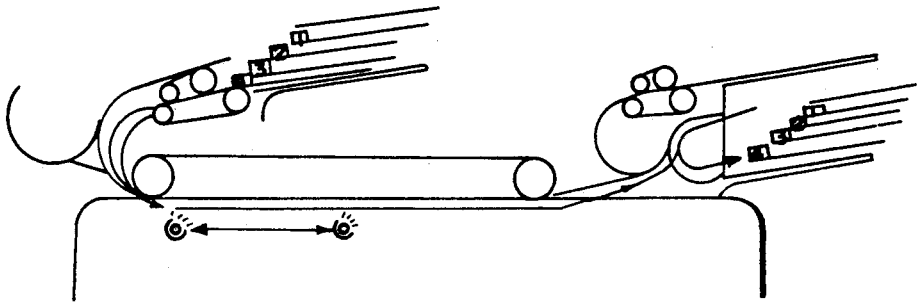
Figure 7:
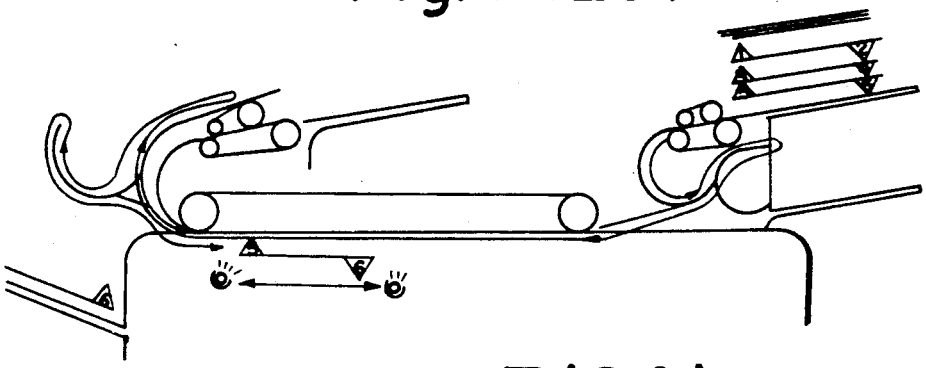
Figure 7:
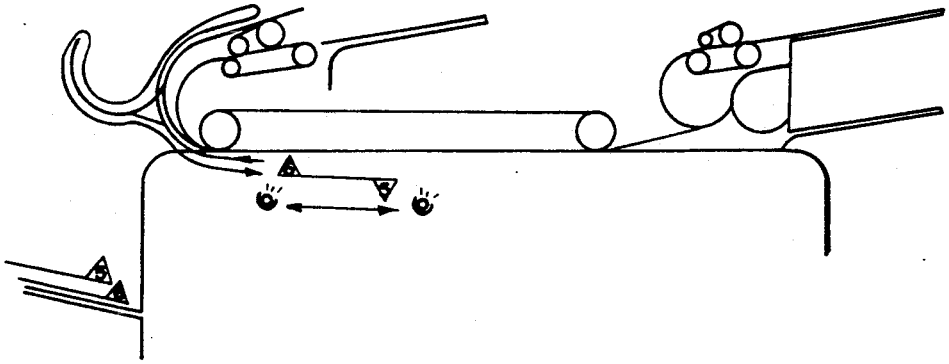
Figure 7:
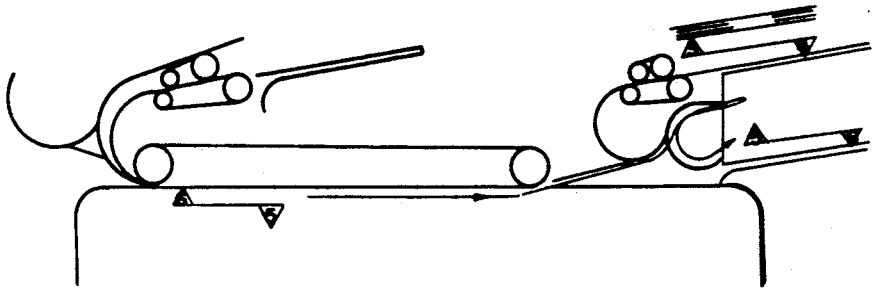
Figure 7:
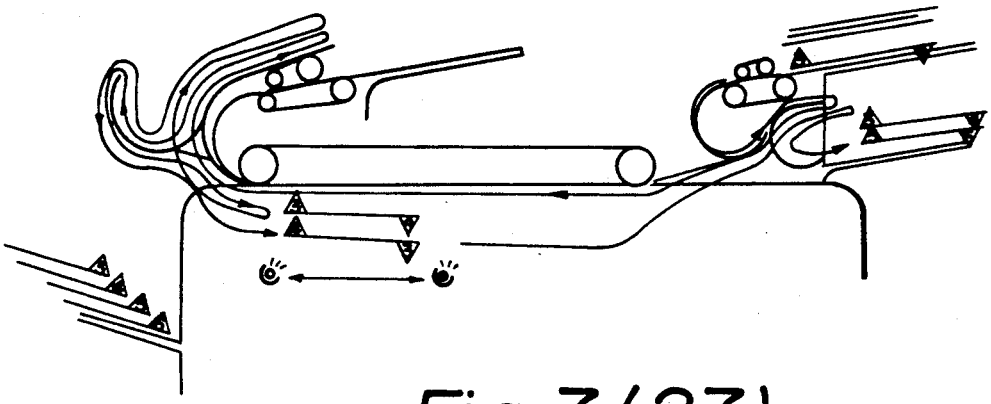
Figure 7:
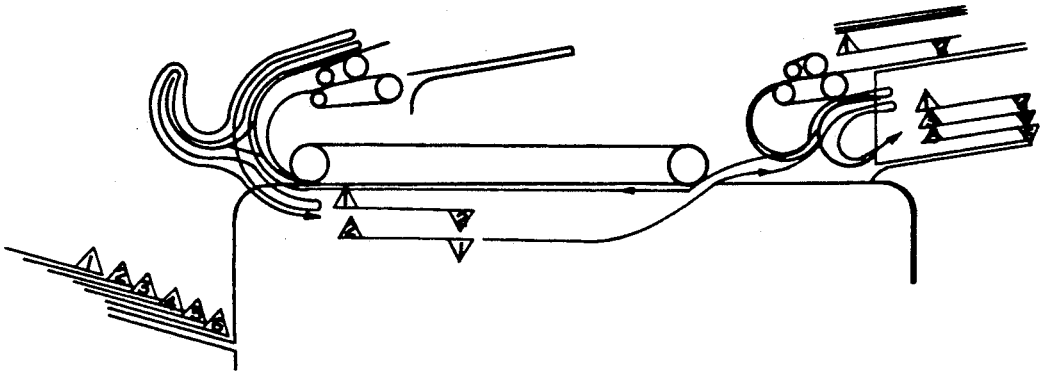
Figure 7:
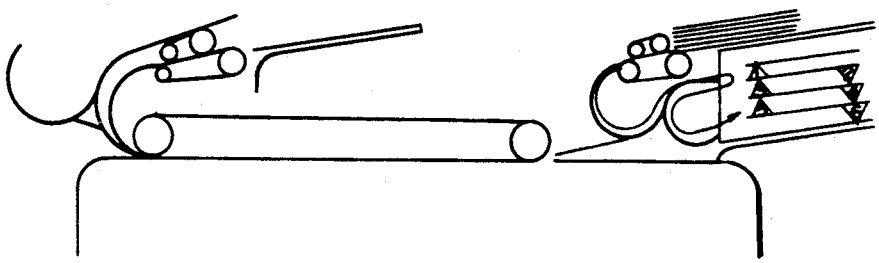
Figure 7:
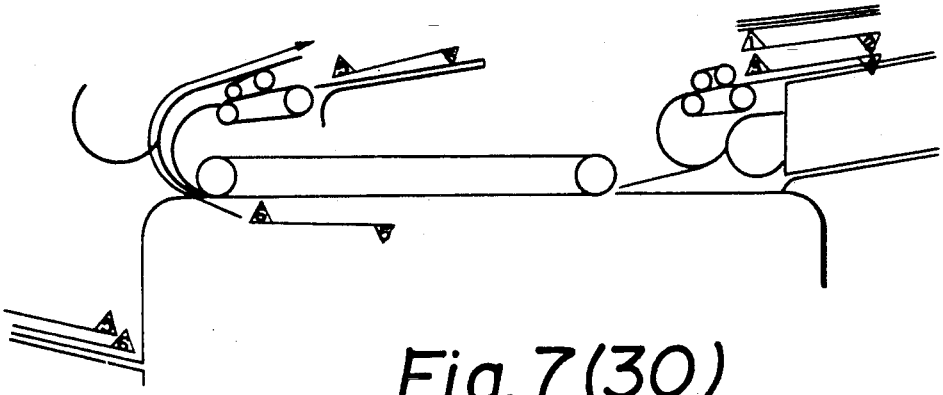
Figure 7:
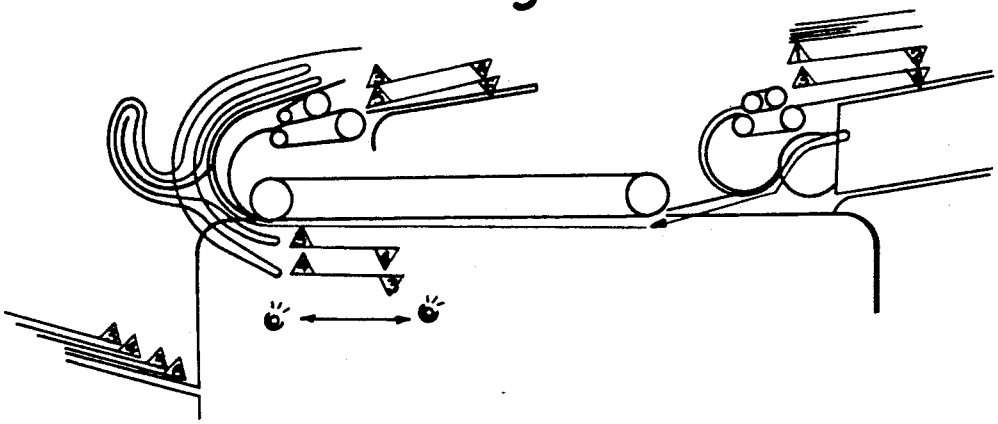
Figure 7:
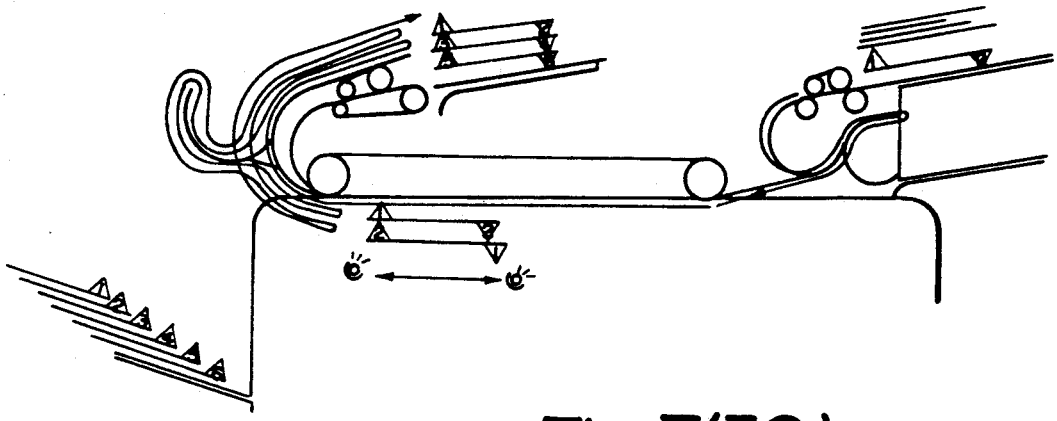
Figure 7:
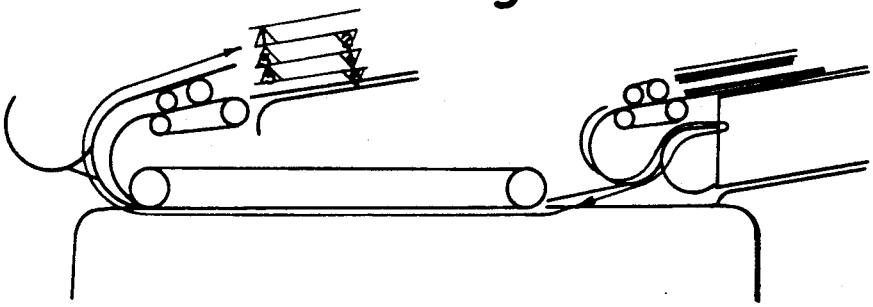
Figure 7:
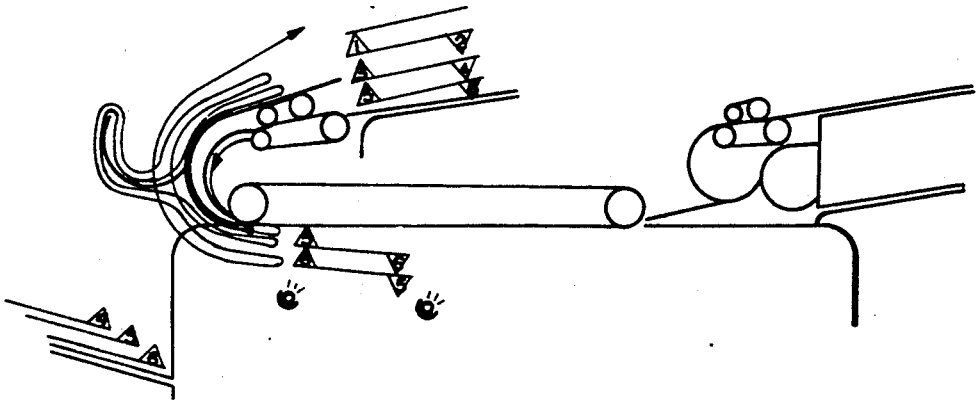
Figure 7:
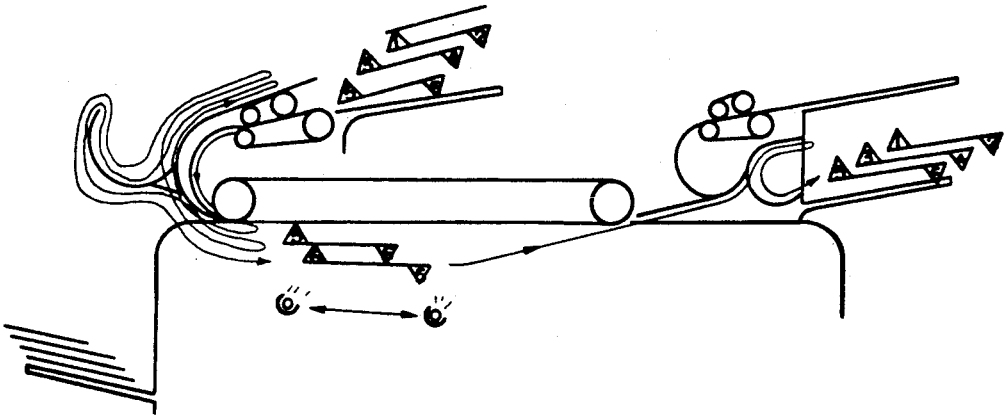
Figure 7:
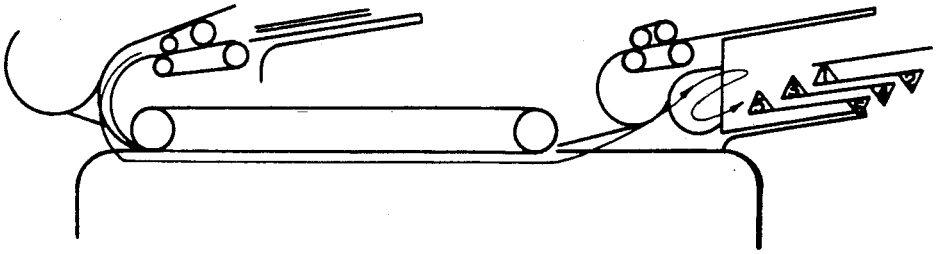
Figure 7:
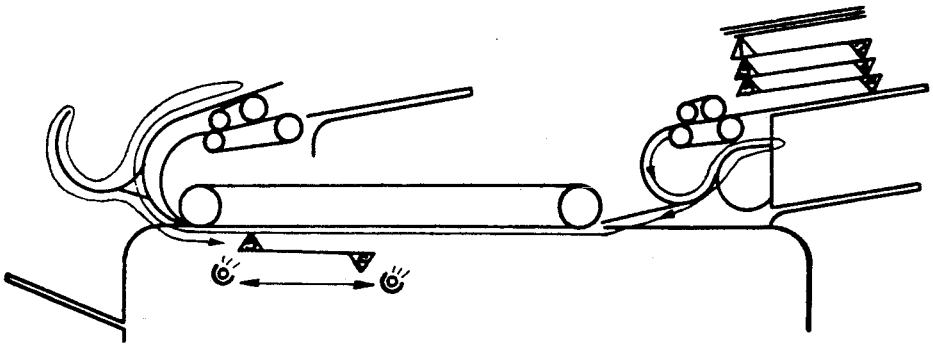
Figure 7:
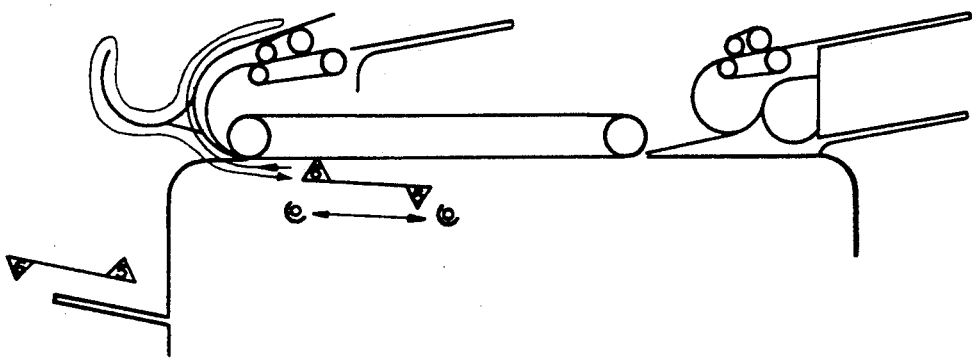
Figure 7:
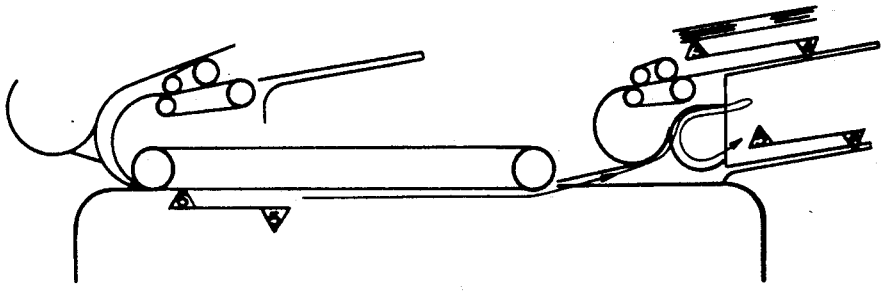
Figure 7:
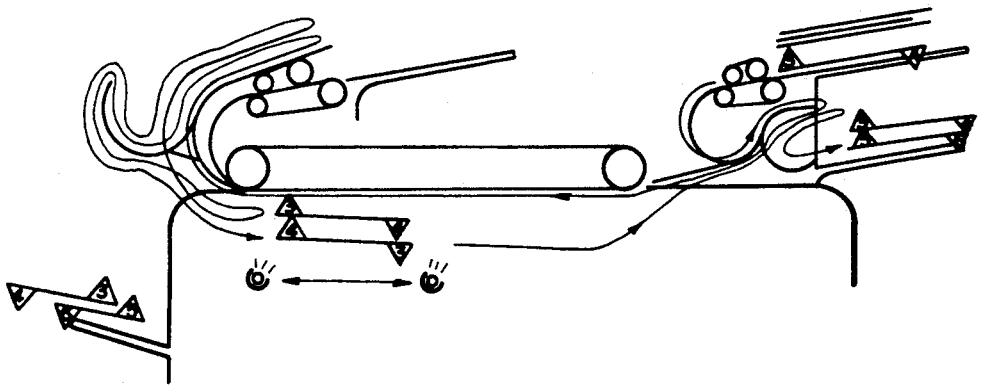
Figure 7:
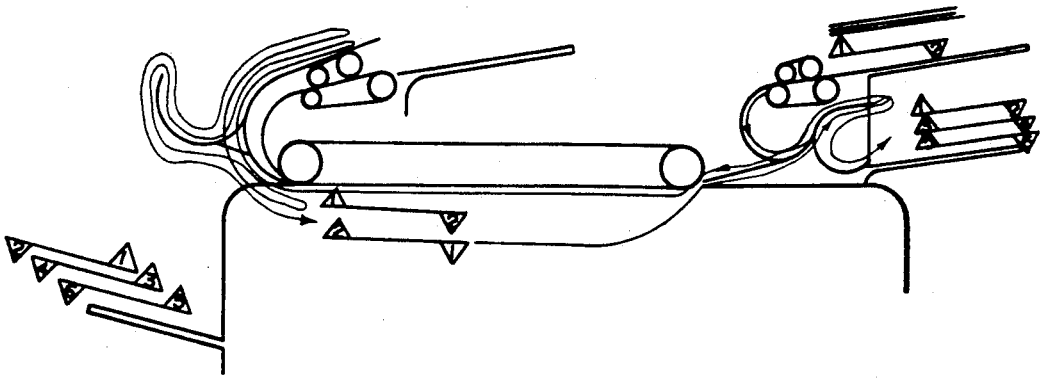
Figure 7:
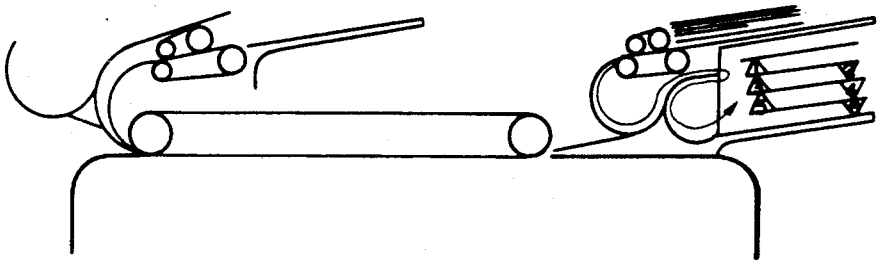
Figure 7:
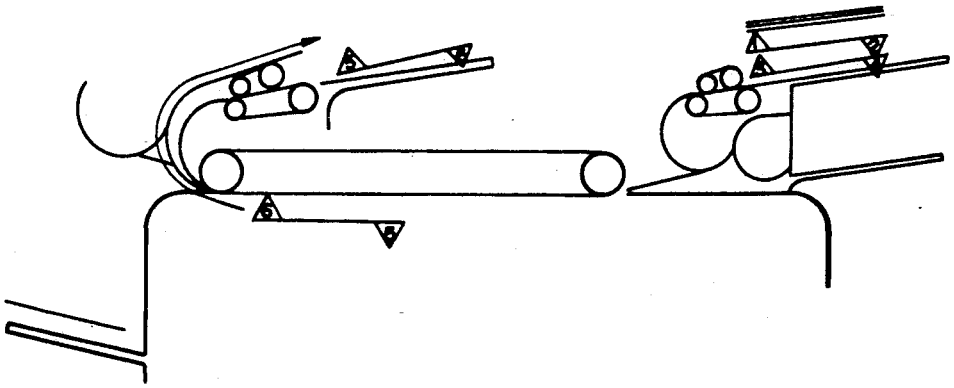
Figure 7:
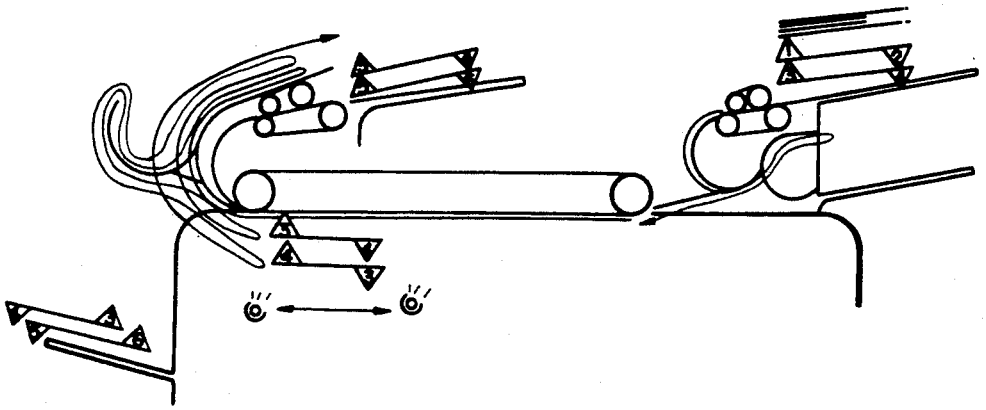
Figure 7:
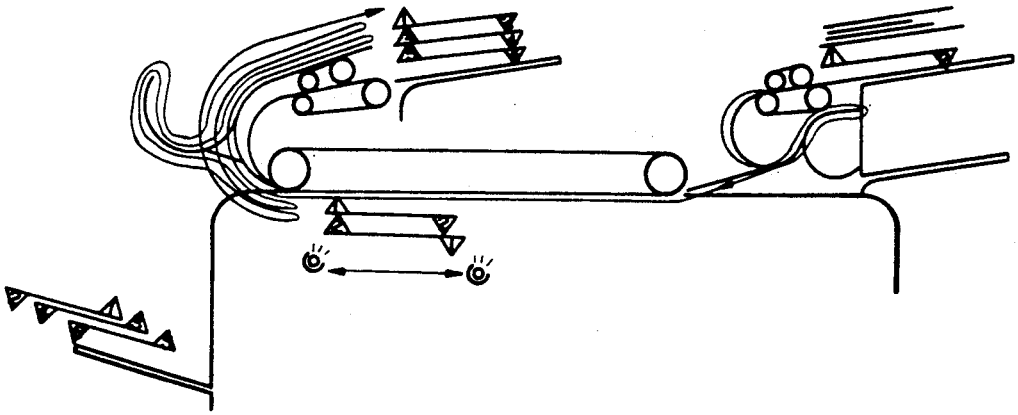
Figure 7:
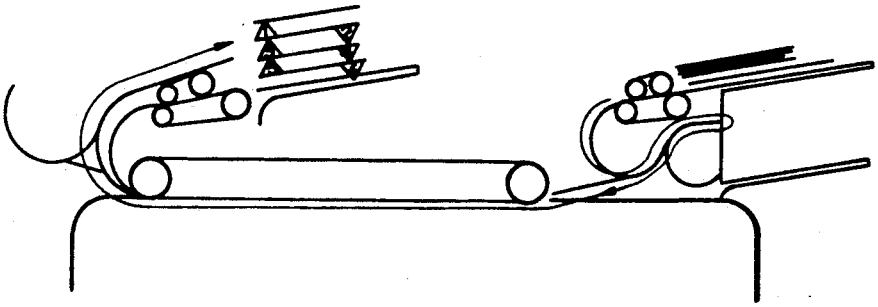
Figure 7:
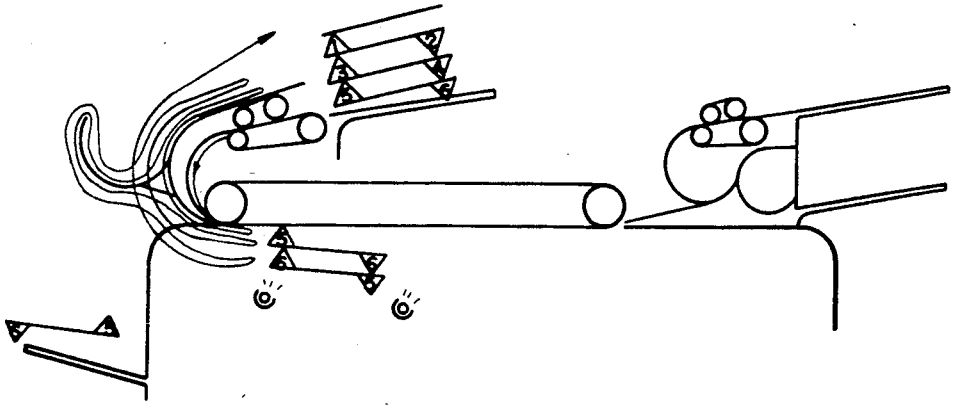
Figure 7:
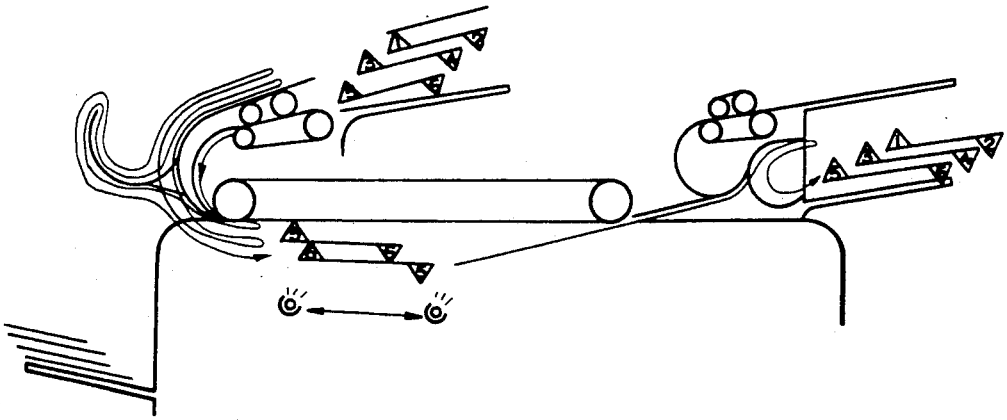
Figure 7:
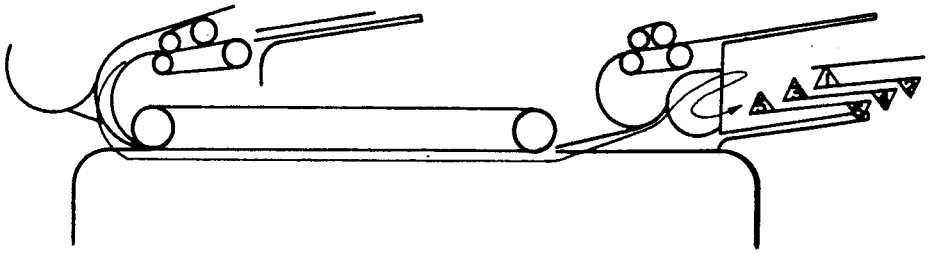

(11) In case of forming a copy only (FIGS. 7(2) to 7(5)), the rotation of the full-width conveyor belt 25 is reversed in response to a signal from the copying machine 100, indicating the completion of the exposure process for the original document of page (3).

(12) In response to the front end detection of the document by the sensor S6, the rollers 16, 16*a*, 17 and 17*a* are activated for forward transportion, whereby the document advances in the order of (d), (b) and (c) in the sheet paths.

(13) The transport rollers 17, 17*a* are switched to reverse transportation, after the lapse of a predetermined time T3, from a rear end detection of the document by the sensor S4.

Before the expiration of said time T3, the rear end of the document of page (3) passes through the deflector 20 and reaches a position in front of the rollers 17, 17*a*.

(14) The above-explained reversing of the rollers 17, 17*a* switches back the document in the portion (c) of the first sheet path, whereby said document enters the third sheet path (e) and is transported toward the discharged document tray 14.

(15) The rotation of the rollers 18, 18*a* discharges the document, with the image bearing face upwards, onto the discharged document tray 14. Said rollers are stopped after the lapse of a predetermined time T4, from the rear end detection by the sensor S5. At this moment, the rear end of the document has completely passed said rollers 18, 18*a*.

(16) Feeding of a succeeding document of page (2) is initiated simultaneously with the stopping of the rollers 18, 18*a*.

(17) Subsequently the steps of A2 to A15 are executed for the documents of pages (2) and (1), and the process for the block D1 is completed.

(18) Then the partition sheet 300A advances in the first sheet path according to the steps A2 to A6. During the transportation the sensor S2 discriminates that the sheet 300A is a partition sheet.

(19) Upon said discrimination, the partition sheet is not switched back into the second sheet path (d) but is discharged to the tray 14 according to the steps A1-3-A15.

(20) In case of forming plural copies (FIGS. 7(6)-7(11)), the full-width conveyor belt 25 is activated in a direction I, in response to an exposure process completion signal from the copying machine 100 for the document of page (3).

(21) The document is transported through paths (h), (i) and (j) of the circulating document feeder B and is discharged on a tray 27 therein, with the image-bearing face upwards.

(22) Subsequent to said discharge of the document of page (3) on the tray 27, succeeding documents of pages (2) and (1) are similarly processed through the paths (a), (b), (c), (d) and (f), then exposed once, further transported through the paths (h), (i) and (j) and discharged on the tray 27, with the image-bearing face upwards.

(23) Then the partition sheet 300A is transported through the paths (a), (b), (c), (d), (f), (h), (i) and (j) and discharged to the tray 27 without the exposure process since it need not be copied.

(24) Then additional copies are made. The documents of the block D1 are separated and transported one by one from the bottom, from the tray 27 of the feeder B.

This operation is achieved by repeating the following steps by a desired number of copies:

| | |
|---|---|
| page (3): | paths (g) - (f) - exposure - (h) - (i) - (j) - tray 27; |
| page (2): | paths (g) - (f) - exposure - (h) - (i) - (j) - tray 27; |
| page (1): | paths (g) - (f) - exposure - (h) - (i) - (j) - tray 27; |
| sheet 300A: | paths (g) - (f) - (h) - (i) - (j) - tray 27. |

Thus the images of the documents of page (3) to page (1) are respectively formed on first faces of copy sheets, which are stacked on the copy tray, with image bearing faces upwards.

(25) When the process for the last copy is completed for the document block D1, steps A11-A17 are conducted for the documents of pages (3) to (1) and for the partition sheet 300A to discharge these sheets onto the tray 14, with the image bearing faces upwards.

B. Process for the block D2 of One-Sided Documents (See FIGS. 7(12)-7(22))

(1) Process for the document block D2 is started when the process for the document block D1 is completed. In response to the detection of the partition sheet 300A indicating the partition between the blocks D1 and D2, the preceding copy mode is reset, and a new copy mode, which is also preset in advance, is adopted for the succeeding documents.

(2) In response to a copy start signal, the solenoid 43 in FIG. 4 is energized to lower the weight member 40, thus pressing the stacked documents downwards.

(3) Subsequently the semi-circular roller 2 and the separation-feed unit S are activated to separate the lowermost sheet on the tray 1, i.e. page [4] of the document block D2 and guide the same into the portion (a) of the first sheet path.

(4) The document of the page [4] in the portion (a) of the first sheet path is subjected to a front end detection by the second sheet sensor S2, and is then stopped by the nip of the transport rollers 15, **15*a* which are then stopped. Said rollers 15, 15*a* are activated after the lapse of a predetermined time T1 from the detection of the document front end by the sheet sensor S2. During said lapse there is created a predetermined loop in the document between the separation-feed unit S and the rollers 15, 15*a***.

(5) When the transport rollers 15, **15*a* are activated, the semi-circular roller 2 and the separation-feed unit S are deactivated. Also the solenoid 43 is deactivated whereby the weight member 40 is lifted and separated from the documents stacked on the tray 1. Even after the roller 2 and the unit S are deactivated, the document of page [4] continues to advance in the portion (a) of the first sheet: path by the rotation of the transport rollers 15, 15*a***.

(6) Subsequently the front end of said document pushes away the deflector plate 19 and enters the nip between the transport rollers 16, **16*a*. It then pushes away the deflector 20 and enters the nip between the transport rollers 17, 17*a***. In this manner the document advances in the order of portions (a), (b) and (c) in the first sheet path.

(7) After the lapse of a predetermined time T2 from the detection of the rear end of the document by the sheet sensor S3, the rotation of the transport rollers is reversed. Simultaneously a full-width conveyor belt 25 of the circulating document feeder B starts to rotate in a direction I. Before the expiration of said time T2, the rear end of the document passes through the deflector 19 and reaches a position in front of the rollers 16, **16*a***.

(8) By the above-mentioned reversing of the rollers 16, **16*a*, the document of page [4] in the first sheet path is transported in a switchback fashion, thus enters the second sheet path (d) and reaches the nip between the conveyor belt 25 and a platen 26** (portion (f)).

(9) The full-width conveyor belt 25 is stopped after a predetermined count of clock signals CL1 from the detection of the document front end by the sensor S6. At the moment of said stopping, the front end of the document of page [4], transported onto the platen glass 26, reaches the position of the predetermined reference line 0 (FIG. 2). In this state the page [4] is placed on the platen glass 26, with the image bearing face downwards.

(10) Then, in response to a stop signal for the full-width conveyor belt 25, the optical system LA of the copying machine 100 starts to move in a direction indicated by a double-dot chain line to effect an exposure process for the original document of page [4] set on the platen glass 26. The copying mode in this state is determined by and executed according to data previously entered through the operation unit. In the present example, it is assumed that the documents of the block D2 are subjected to a copy process for obtaining two-sided copies from one-sided originals. In such mode, the image of page [4] of the original document is formed on a first face of a copy sheet, which is transported once to a re-transport mechanism in the copying machine, equipped with an intermediate tray 402 and a feed roller 403.

In the following there will be separately explained a case of forming a copy from the original and another case of forming plural copies.

(11) In case of forming a copy only (FIGS. 7(13)-7(16)), the full-width conveyor belt 25 is reversed into a direction II, in response to an exposure process completion signal for the document of page [4].

(12) In response to the front end detection of the document by the sensor S6, the rollers 16, 16*a*, 17 and 17*a* are activated for forward transportation, whereby the document advances along the sheet paths (d), (b) and (c).

(13) The transport rollers 17, 17*a* are switched to reverse transportation, after the lapse of a predetermined time T3, from a rear end detection of the document by the sensor S4.

Before the expiration of said time T3, the rear end of the document of page [4] passes through the deflector 20 and reaches a position in front of the rollers 17, 17*a*.

(14) The above-explained reversing of the rollers 17, 17*a* switches back the document in the portion (c) of the first sheet path, whereby said document enters the third sheet path (e) and is transported toward the tray 14.

(15) The rotation of the rollers 18, 18*a* discharges the document, with the image bearing face upwards, onto the tray 14. Said rollers are stopped after the lapse of a predetermined time T4, from the rear end detection by the sensor S5. At this moment, the rear end of the document has completely passed said rollers 18, 18*a*.

(16) Feeding of a succeeding document of page [3] is initiated simultaneously with the stopping of the rollers 18, 18*a*.

(17) Then the document of page [3] is set on the platen glass, with the image bearing face downwards, through the steps of A2 to A9.

(18) In response to a stop signal indicating the termination of forward rotation of the full-width conveyor belt 27, the optical system LA of the copying machine starts an exposure process for the original document of page [3] set on the platen glass. The copy sheet already having the image of page [4] on the first face thereof is fed from the re-transport mechanism 402, 403, and the image of page [3] is formed on the second face to obtain a two-sided copy, which is then discharged to the copy tray 400, with the image of page [3] upwards.

(19) Subsequently similar steps are conducted for the documents of pages [2] and [1] to complete the process for the document block D2.

(20) Then the partition sheet 300B advances in the first sheet path according to the steps A2 to A6. During the transportation the sensor S2 discriminates that the sheet 300B is a partition sheet.

(21) Upon said discrimination, the partition sheet is not switched back into the second sheet path (d) but is discharged to the tray 14 according to the steps A1-3-A15.

(22) In case of forming plural copies (FIGS. 7(17)-7(22)), the full-width conveyor belt 25 is activated in a direction I, in response to an exposure process completion signal from the copying machine 100 for the document of page [4].

(23) The document is transported through the paths (h), (i) and (j) of the circulating document feeder B and is discharged on the tray 27 therein, with the image bearing face upwards.

(24) Subsequent to said discharge of the document of page [4] on the tray 27, succeeding documents of pages [3]-[1] are similarly processed through the path (a), (b), (c), (d) and (f), then exposed once, further transported through the paths (h), (i) and (j) and discharged on the tray 27, with the image-bearing faces upwards.

(25) Then the partition sheet 300B is transported through the paths (a), (b), (c), (d), (f), (h), (i) and (j) and discharged to the tray 27, without the exposure process since it need not be copied.

(26) Then additional copies are made. The documents of the block D2 are separated and transported one by one from the bottom, from the tray 27 of the feeder B.

This operation is achieved by repeating the following steps by a desired number of times:

| | |
|---|---|
| page [3]: | paths (g) - (f) - exposure - (h) - (i) - (j) - tray 27; |
| page [2]: | paths (g) - (f) - exposure - (h) - (i) - (j) - tray 27; |
| page [1]: | paths (g) - (f) - exposure - (j) - (i) - (j) - tray 27; |
| sheet 300B: | paths (g) - (f) - (h) - (i) - (j) - tray 27. |

Thus the copy sheets, having the images of pages [4] and [3], or pages [2] and [1], on both faces thereof, are stacked on the copy tray, with the images of odd pages upwards.

(27) When the process for the last copy is completed for the document block D2, steps A11-A17 are conducted for the documents of pages [4] to [1] and for the partition sheet 300B to discharge these sheets onto the tray 14, with the image bearing faces upwards.

C. Process for the block D3 of Two-Sided Documents (See FIGS. 7(23)-7(35))

(1) Process for the document block D3 is started when the process for the document block D2 is completed. In response to the detection of the partition sheet 300B indicating the partition between the blocks D2 and D3, the preceding copy mode is cancelled, and a new copy mode, which is also preset in advance, is adopted for the succeeding documents.

(2) In response to a copy start signal, the solenoid 43 in FIG. 4 is energized to lower the weight member 40, thus pressing the stacked documents downwards.

(3) Subsequently the semi-circular roller 2 and the separation-feed unit S are activated to separate the lowermost sheet on the tray 1, i.e. P3 of the document block D3 and guide the same into the portion (a) of the first sheet path.

(4) The document P3 in the portion (a) of the first sheet path is subjected to a front end detection by the second sheet sensor S2, and is then stopped by the nip of the transport rollers 15, 15*a* which are stopped in this state. Said rollers 15, 15*a* are activated after the lapse of a predetermined time T1 from the detection of the document front end by the sheet sensor S2. During said time there is created a predetermined loop in the document between the separation-feed unit S and the rollers 15, 15*a*.

(5) When the transport rollers 15, 15*a* are activated, the semi-circular roller 2 and the separation-feed unit S are deactivated. Also the solenoid 43 is deactivated whereby the weight member 40 is lifted and separated from the documents stacked on the tray 1. Even after the roller 2 and the unit S are deactivated, the document P3 continues to advance in the portion (a) of the first sheet path by the rotation of the transport rollers 15, 15*a*.

(6) Subsequently the front end of said document pushes away the deflector plate 19 and enters the nip between the transport rollers 16, 16*a*. It then pushes away the deflector 20 and enters the nip between the transport rollers 17, 17*a*. In this manner the document advances in the order of portions (a), (b) and (c) in the first sheet path.

(7) After the lapse of a predetermined time T2 from the detection of the rear end of the document by the sheet sensor S3, the rotation of the transport rollers is reversed. Simultaneously the full-width conveyor belt 25 of the circulating document feeder B starts to rotate in a direction I. Before the expiration of said, time T2, the rear end of the document passes the deflector 19 and reaches a position in front of the rollers 16, 16*a*.

(8) By the above-mentioned reversing of the rollers 16, 16*a*, the document P3 in the first sheet path is switched back into the second sheet path (d) and reaches the nip between the conveyor belt 25 and the platen 26 (portion (f)).

(9) The document P3, being two-sided, is transported through the paths (f) (without exposure) - (h) - (j) - switchback - (k) - (1) - switchback - (m) - (h) - (f) and is set on the platen glass 26, with alignment to the reference line 0 and with a sixth page of the document downwards.

(10) Then, in response to a stop signal for the full-width conveyor belt 25, the optical system LA of the copy machine 100 starts to conduct an exposure process for the page 6 of the document P3 set on the platen glass 26. The copying mode in this state is determined by and executed according to data previously entered through the operation unit. In the present example it is assumed that the documents of the block D3 are subjected to a copy process for obtaining one-sided copies from two-sided originals. In such mode, the image of page 6 of the document P3 is formed on a first face of a copy sheet, which is discharged onto the tray 400, with the image bearing face upwards.

(11) Upon completion of the exposure process for page 6 of the document P3, it is transported, by the rotation of the full-width conveyor belt, through the paths (h) - (i) - (j) - (k) - (1) - (m) - (h) - (f) and is set again on the platen glass 26, with alignment to the reference line 0 and with the page 5 facing downwards.

(12) An exposure process is conducted in the same manner as for the page 6 of the document P3, and an obtained copy is discharged onto the copy tray 400, with the image bearing face upwards.

In the following there will be separately explained a case of forming a copy from the original and another case of forming plural copies.

(13) In case of forming a copy only (FIGS. 7(24)–7(28)), the full-width conveyor belt 25 is reversed into a direction II, in response to an exposure process completion signal for the page 5 of the document P3.

(14) In response to the detection of the front end of the document P3 by the sensor S6, the rollers 16, 16*a*, 17 and 17*a* are activated for forward transportation, whereby the document advances along the sheet paths (d) to (c).

(15) The transport rollers 17, 17*a* are switched to reverse transportation, after the lapse of a predetermined time T3, from the detection of the document rear end by the sensor S4. Before the expiration of said time T3, the rear end of the document P3 passes through the deflector 20 and reaches a position in front of the rollers 17, 17*a*.

(16) The above-explained reversing of the rollers 17, 17*a* switches back the document into the portion (c) of the first sheet path, whereby said document enters the third sheet path (e) and is transported toward the tray 14.

(17) The rotation of the rollers 18, 18*a* discharges the document, with the odd page facing upwards. Said rollers are stopped after the lapse of a predetermined time T4, from the rear end detection by the sensor S5. At this moment, the rear end of the document has completely passed said rollers 18, 18*a*.

(18) Feeding of a succeeding document P2 is initiated simultaneously with the stopping of the rollers 18, 18*a*.

(19) Subsequently the steps of C2–C17 are repeated for the documents P2 and P1, thus completing the process for the document block D3.

(20) Then the partition sheet 300C advances in the first sheet path according to the steps A2 to A6. During the transportation the sensor S2 discriminates that the sheet 300C is a partition sheet.

(21) Upon said discrimination, the partition sheet is not switched back into the second sheet path (d) but is discharged to the tray 14 according to the steps A1-3–A15.

(22) In case of forming plural copies (FIG. 7(29)–7(35)), the full-width conveyor belt 25 is activated in a direction I, in response to an exposure process completion signal from the copying machine 100 for the document P3.

(23) The document is transported through the paths (h), (i) and (j) of the circulating document feeder B and is discharged on the tray 27 therein, with the odd page facing upwards.

(24) Subsequent to said discharge of the document P3 on the tray 27, succeeding documents P2 and P1 are respectively subjected to the transport/exposure steps of (a) - (b) - (c) - (d) - (f) - (h) - (i) - (j) - (k) - (1) - (m) - (h) - exposure (even page) - (h) - (i) - (j) - (k) - (1) - (m) - (h) - exposure (odd page) - (h) - (i) - (j) and discharged onto the tray 27, with the odd pages facing upwards.

(25) Then the partition sheet 300C is transported through the paths (a), (b), (c), (d), (f), (h), (i) and (j) and discharged to the tray 27, without the exposure process since it need not be copied.

(26) Then additional copies are made. The documents of the block D3 are separated and transported one by one from the bottom, from the tray 27 of the feeder B.

This operation is achieved by repeating the following steps by a desired number of times:

| | |
|---|---|
| document P3: | paths (g) - (f) - (h) - (i) - (j) - (k) - (1) - (m) - (h) - exposure of page 6 - (h) - (i) - (j) - (k) - (1) - (m) - (h) - exposure of page 5 - (h) - (i) - (j) - tray 27; |
| document P2: | paths (g) - (f) - (h) - (i) - (j) - (k) - (1) - (m) - (h) - exposure of page 4 - (h) - (i) - (j) - (k) - (1) - (m) - (h) - exposure of page 3 - (h) - (i) - (j) - tray 27; |
| document Pl: | paths (g) - (f) - (h) - (i) - (j) - (k) - (1) - (m) - (h) - exposure of page 2 - (h) - (i) - (j) - (k) - (1) - (m) - (h) - exposure of page 1 - (h) - (i) - (j) - tray 27. |

Thus the images of pages 6 to 1 are formed on the first faces of the copy sheets, which are stacked in succession on the copy tray, with the image bearing faces upwards.

(27) When the process for the odd page of the last document is completed for the document block D3, steps C13 to C17 are conducted for the documents P3–P1 and the partition sheet 300C to discharge these sheets onto the tray 14, with the odd pages facing upwards.

D. Process for the block D4 of Two-Sided Documents (see FIGS. 7(36)–7(48))

(1) Process for the document block D4 is started when the process for the document block D3 is completed. In response to the detection of the partition sheet 300C indicating the partition between the blocks D3 and D4, the preceding copy mode is cancelled, and a new copy mode, which is also present in advance, is adopted for the succeeding documents.

(2) In response to a copy start signal, the solenoid 43 in FIG. 4 is energized to lower the weight member 40, thus pressing the stacked documents downwards.

(3) Subsequently the semi-circular roller 2 and the separation-feed unit S are activated to separate the lowermost sheet on the tray 1, i.e. P3 of the document block D4 and guide the same into the portion (a) of the first sheet path.

(4) The document P3 in the portion (a) of the first sheet path is subjected to a front end detection by the second sheet sensor S2, and is then stopped by the nip of the transport rollers 15, 15*a* which are stopped in this state. Said rollers 15, 15*a* are activated after the lapse of a predetermined time T1 from the detection of the document front end by the sheet sensor S2. During said time there is created a predetermined loop in the document between the separation-feed unit S and the rollers 15, 15*a*.

(5) When the transport rollers 15, 15*a* are activated, the semi-circular roller 2 and the separation-feed unit S are deactivated. Also the solenoid 43 is deactivated whereby the weight member 40 is lifted and separated from the documents-stacked on the tray 1. Even after the roller 2 and the unit S are deactivated, the document P3 continues to advance in the portion (a) of the first sheet path by the rotation of the transport rollers 15, 15*a*.

(6) Subsequently the front end of said document pushes away the deflector plate 19 and enters the nip between the transport rollers 16, 16*a*. It then pushes away the deflector 20 and enters the nip between the transport rollers 17, 17*a*. In this manner the document advances in the order of portions (a), (b) and (c) in the first sheet path.

(7) After the lapse of a predetermined time T2 from the detection of the rear end of the document by the sheet sensor S3, the rotation of the transport rollers is reversed. Simultaneously the full-width conveyor belt 25 of the circulating document feeder B starts to rotate in a direction I. Before the expiration of said time T2, the rear end of the document passes the deflector 19 and reaches a position in front of the rollers 16, 16*a*.

(8) By the above-mentioned reversing of the rollers 16, 16*a*, the document P3 in the first sheet path is switched back into the second sheet path (d) and reaches the nip between the conveyor belt 25 and the platen 26 (portion(f)).

(9) The document P3, being two-sided, is transported through the paths (f) - (h) - (j) - switchback - (k) - (l) - switchback - (m) - (h) - (f) and is set on the platen glass 26, with alignment to the reference line 0 and with a sixth page of the document facing downwards.

(10) Then, in response to a stop signal for the full-width conveyor belt 25, the optical system LA of the copying machine 100 starts to conduct an exposure process for the page 6 of the document P3 set on the platen glass 26. The copying mode in this state is determined by and executed according to data previously entered through the operation unit.

In the present example, it is assumed that the documents of the block D4 are subjected to a copy process for obtaining two-sided copies from two-sided originals. In such mode, the image of page 6 of the document P3 is formed on a first face of a copy sheet, which is then transported to the re-transport mechanism 402 in the copying machine.

(11) Upon completion of the exposure process for page 6 of the document P3, it is transported, by the rotation of the full-width conveyor belt, through the paths (h) - (i) - (j) - (k) - (1) - (m) - (h) - (f) and is set again on the platen glass 26, with alignment to the reference line 0 and with the page 5 facing downwards.

(12) An exposure process is conducted in the same manner as for the page 6 of the document P3, and an obtained copy is discharged onto the copy tray, with the odd page facing upwards.

In the following there will be separately explained a case of forming a copy from the original and another case of forming plural copies.

(13) In case of forming a copy only (FIGS. 7(37)–7(41)), the full-width conveyor belt 25 is reversed into a direction II, in response to an exposure process completion signal for the document P3, obtained from the copying machine 100.

(14) In response to the detection of the front end of the document P3 by the sensor S6, the rollers 16, 16*a*, 17 and 17*a* are activated for forward transportation, whereby the document advances along the paths (d), (e) and (c).

(15) The transport rollers 17, 17*a* are switched to reverse transportation, after the lapse of a predetermined time T3, from the detection of the document rear end by the sensor S4. Before the expiration of said time T3, the rear end of the document P3 passes through the deflector 20 and reaches a position in front of the rollers 17, 17*a*.

(16) The above-explained reversing of the rollers 17, 17*a* switches back the document into the portion (c) of the first sheet path, whereby said document enters the third sheet path (e) and is transported toward the tray 14.

(17) The rotation of the rollers 18, 18*a* discharges the document to the tray 14, with the odd page facing upwards. Said rollers are stopped after the lapse of a predetermined time T4 from the rear end detection by the sensor S5. At said stopping the rear end of the document has completely passed said rollers 18, 18*a*.

(18) Feeding of a succeeding document P2 is initiated simultaneously with the stopping of the rollers 18, 18*a*.

(19) Subsequently the steps of D2–D17 are repeated for the documents P2 and P1, thus completing the process for the document block D4.

(20) Then the partition sheet 300D advances in the first sheet path according to the steps A2 to A6. During the transportation the sensor S3 discriminates that the sheet 300D is a partition sheet.

(21) Upon said discrimination, the partition sheet if not switched back into the second sheet path (d) but is discharged to the tray 14 according to the steps A1-3–A15.

(22) In case of forming plural copies (FIGS. 7(42)–7(48)), the full-width conveyor belt 25 is activated in a direction I, in response to an exposure process completion signal from the copying machine 100 for the document P2.

(23) The document is transported through the paths (h), (i) and (j) of the circulating document feeder B and is discharged on the tray 27 therein, with the odd page facing upwards.

(24) Subsequent to said discharge of the document P3 on the tray 27, succeeding documents P2 and P1 are respectively subjected to the transport/exposure steps of (a) - (b) - (c) - (d) - (f) - (h) - (i) - (j) - (k) - (l) - (m) - (h) - exposure (even page) - (h) - (i) - (j) - (k) - (l) - (m) - (h)- exposure (odd page) - (h) -(i) - (j) and discharged onto the tray 27, with the odd pages facing upwards.

(25) Then the partition sheet 300D is transported through the paths (a), (b), (c), (d), (f), (h), (i) and (j) and discharged to the tray 27, without the exposure process since it need not be copied.

(26) Then additional copies are made. The documents of the block D4 are separated and transported one by one from the bottom, from the tray 27 of the feeder B.

This operation is achieved by repeating the following steps by a desired number of times:

| | |
|---|---|
| document P3: | paths (g) - (f) - (h) - (i) - (j) - (k) - (1) - (m) - (h) - exposure of page 6 - (h) - (i) - (j) - (k) - (1) - (m) - (h) - exposure of page 5 - (h) - (i) - (j) - tray 27; |
| document P2: | paths (g) - (f) - (h) - (i) - (j) - (k) - (1) - (m) - (h) - exposure of page 4 - (h) - (i) - (j) - (k) - (1) - (m) - (h) - exposure of page 3 - (h) - (i) - (j) - tray 27; |
| document Pl: | paths (g) - (f) - (h) - (i) - (j) - (k) - (1) - (m) - (h) - exposure of page 3 - (h) - (i) - (j). - (k) - (1) (m) - (h) - exposure of page 1 - (h) - (i) - (j) - tray 27. |

Thus copies having images of pages 6 and 5, or pages 4 and 3, or pages 2 and 1, are stacked on the copy tray 400 in succession, with the images of odd pages facing upwards.

(27) When the process for the odd page of the last document is completed for the document block D4, steps S13 to S17 are conducted for the documents P3–P1 and the partition sheet 300D to discharge these sheets onto the tray 14, with the odd pages facing upwards.

When all the document blocks D1–D4 are processed, the first sheet sensor S1 detects the absence of documents on the tray 1 and terminates the process.

The documents after processing are stacked on the tray 14, in the same order as in the initial setting, and need not be re-sorted.

Also the copy sheets are discharged in the same order as that of the original documents and need not therefore be rearranged.

In the foregoing explanation the obtained copies are discharged onto the tray 400 of the copying machine 100, but there may be employed, instead of said tray, a known sorter for achieving a further improved efficiency and effecting satisfactory process even when the total number of desired copies exceeds the number of bins of the sorter.

More specifically, a linked operation with the circulating document feeder allows to achieve satisfactory processing of a large number of copies even when the total number of desired copies exceeds the number of bins of the sorter.

In case of employing a sorter instead of the tray 400, the process sequence for obtaining plural copies is changed in the following manner.

In case of obtaining two-sided copies from two-sided originals, an original document of which one face has been subjected to exposure is transported through the paths (h), (i), (j), (k), (1), (m), (h) and (f) and is set again on the plate glass 26 for the exposure of the other face, and a two-sided copy thus obtained is discharged to a first tray. Then the first face of the same original document is again set on the platen glass 26 and exposure, and the other face is then set and exposed on the platen glass 26. A correspondingly obtained two-sided copy is discharged in a second tray. After the above-explained operation is repeated for a desired number of times, the original document is discharged to the tray 14, and a succeeding document is subjected to a same procedure. Consequently, the original documents are never transported to the tray 27.

Also it is possible to adopt the following sequence.

A face of the document is set on the platen glass 26 and is subjected to exposure of plural times, and obtained plural copy sheets, bearing images on one faces thereof, are temporarily stacked on the intermediate tray 402. Then the document is inverted and set again on the platen glass 26, and the image on the reverse face is copied on the reverse faces of the copy sheets supplied from the tray 402. The two-sided copies thus obtained are sequentially sorted in the sorter. The original document is discharged to the tray 14, without going into the tray 27.

Figure 8:
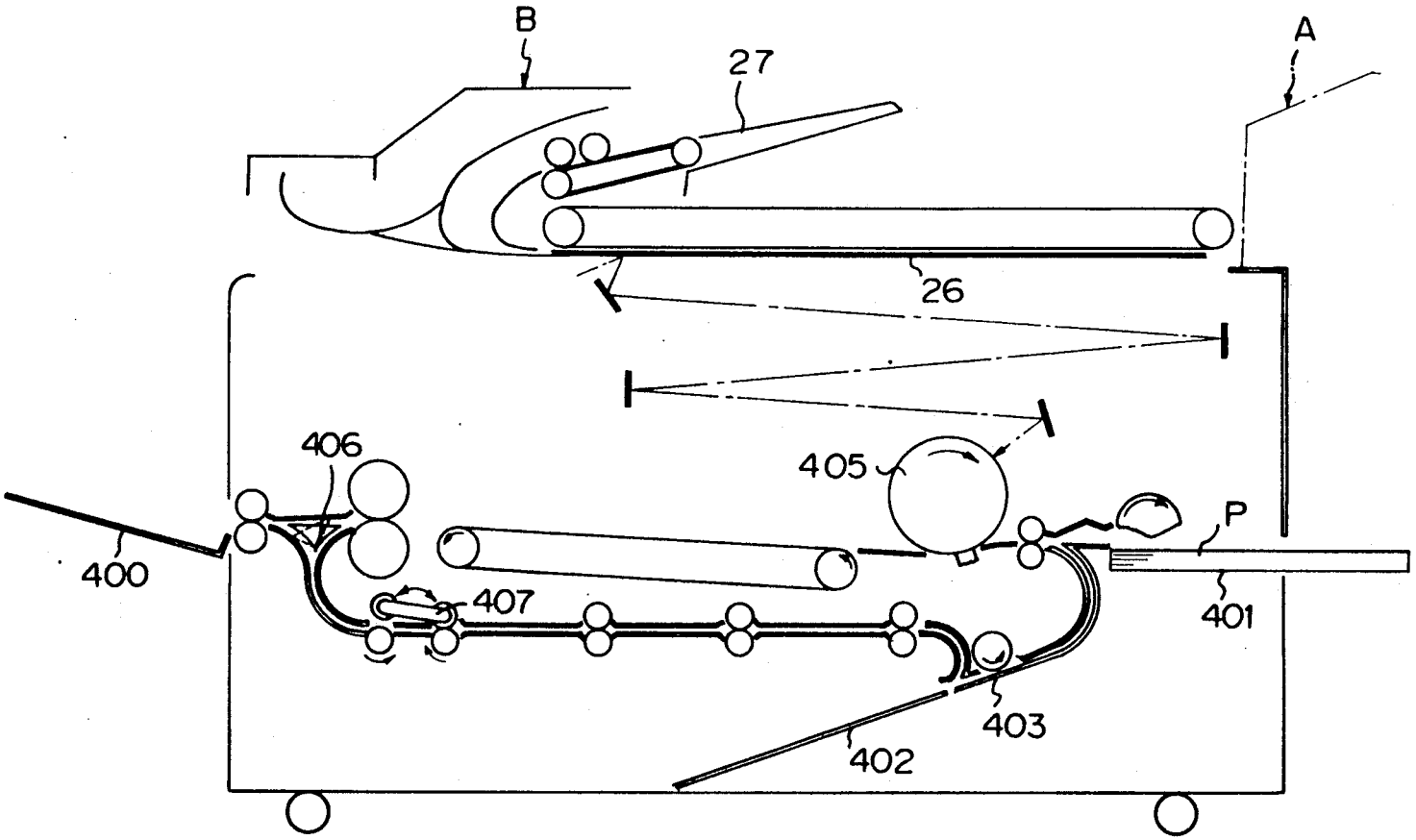
FIG. 8 is a cross-sectional view of an image forming apparatus equipped with a document feeder of the present invention.

In FIG. 8 there are shown a cassette 401 for storing copy sheets; a photosensitive drum 405; a switch lever 406 for switching copy sheets; and a switchback roller 407 which is movable between a position for a path position 408 for advancing the copy sheets to the intermediate tray 402 and a position for advancing the copy sheets to the tray 400 by means of the lever 406.

Separator means S' of the circulating original document feeder B has the same structure as that of the separator means S of the document feeder A, so that a normal copying operation can be conducted by stacking the original documents on the tray, with the first page on top, if no reservation is required for the copying operation. In this case the documents are circulated through the paths of (g) - (f) - exposure - (h) - (i) - (j) - tray 27. Also for two-sided documents the circulation is conducted in the order of (g) - (f) - (h) - (i) - (j) - (k) - (l) - (m) -(h) - (f) - exposure of first face - (h) - (i) - (j) - (k) - (l) - (m) - (h) - (f) - exposure of second face - (h) - (i) - (j) - tray 27.

Figure 9:
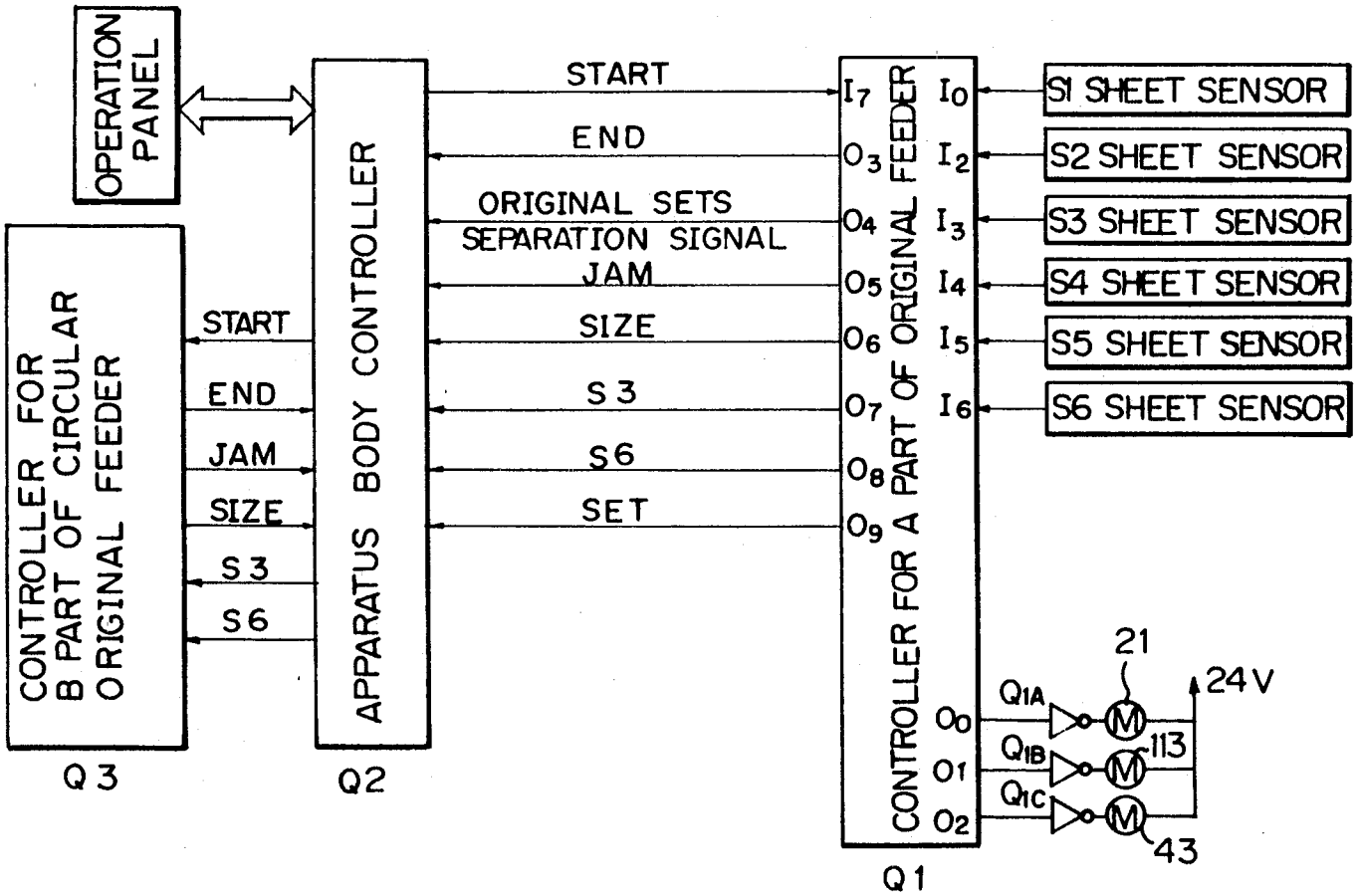
FIG. 9 is a block diagram of a control circuit of an image forming apparatus of the present invention.

FIG. 9 is a block diagram of the apparatus of the present invention, wherein shown are a control unit Q1 of the document feeder; a control unit Q2 of the main apparatus; a control unit Q3 of the recycle feeder B, all composed of one-chip microcomputers including ROM, RAM, I/0 latches etc.; input ports I0–I7; output ports O0–O2; and drivers Q1A–Q1C composed for example of transistors.

The input ports I0–I6 receive signals from the sheet sensors S1–S6, while the output ports O0–02 release control signals for the motor 21, drive motor 113 and solenoid 43.

Input port I7 and output ports O3–O9 constitute communications ports with the main apparatus, wherein the input port I7 receives the start signal from the main apparatus while the output ports O3–O9 provide the main apparatus with signals indicating the document size on the feeder A, partitions between blocks, presence or absence of document setting etc.

The partition sheet, indicating the partition of the document blocks, may include information for setting the copy mode for the succeeding document block. In this case the partition sheet bears certain markings indicating the copy mode, which are read by the sensor S2 and transmitted to the control unit Q2.

It is also possible to separate the document blocks by inserting a rotatable lever between such blocks.

What is claimed is:

1. An original document feeder comprising:

stacker means for stacking original documents;

feed means for one by one feeding of thus stacked original documents;

means defining a first sheet path which curves downwardly for feeding, with inversion, an original document fed by said feed means;

means defining a second sheet path branched from said first sheet path in a switchback fashion for guiding the original document to a process unit;

transport means for positioning adjacent to the process unit and capable of a reverse rotation for discharging the original document, supplied from said second sheet path means, into said second sheet path means;

document received means for receiving original documents; and means defining a third sheet path which curves downwardly and is branched from said first sheet path means in a switchback fashion, for feeding, with inversion, the original document discharged by said transport means to said document receiver means;

wherein said stacker means, first sheet path means, second sheet path means, third sheet path means and document receiver means are constructed and arranged for positioning at an entrance to the process unit.

2. An original document feeder according to claim 1, further comprising means for detecting partitions between plural blocks of original documents, for the purpose of switching copying modes.

3. An original document feeder according to claim 2, wherein said partition detecting means comprises a partition sheet inserted between the blocks of original documents, and a sensor provided in said first sheet path means and adapted to detect the passing of said partition sheet.

4. An original document according to claim 3, further comprising means for controlling in such a manner that the partition sheet is discharged from said first sheet path means to the original document receiver means through said third sheet path.

5. An original document feeder according to claim 3, further comprising means for controlling in such a manner that the original document is guided from the first sheet path means to the process unit through the second sheet path means, and is then discharged from the second sheet path means to the document receiver means through the third sheet path means.

6. An original document handling device comprising:

an original document feeder A including first stacker means for stacking original documents, said first stacker means being adapted to receive manually-set original documents; first feed means for one-by-one feeding of the stacked original documents; means defining a first sheet path for guiding the original document fed by said first feed means; means defining a second sheet path for guiding an original document from said first sheet path means to a process unit; and means defining a third sheet path for guiding the original document from either said first sheet path means or said process unit to a document receiver means;

an original document feeder B including second stacker means for stacking original documents, said second stacker means being adapted to receive manually-set original documents; second feed means for one-by-one feeding of the stacked original documents; means defining a fourth sheet path for guiding an original document fed by said second feed means to the process unit; and means defining a fifth sheet path for guiding the original document discharged from the process unit to said second stacker means; and control means for advancing the original document from said document feeder A to said document feeder B when a process in said document feeder B is to be performed.

7. An original document feeder according to claim 6, further comprising means for detecting partitions between plural blocks of original documents, for the purpose of switching copying modes.

8. An original document feeder according to claim 7, wherein said partition detecting means comprises a partition sheet inserted between the blocks of original documents, and a sensor provided in said first sheet path means and adapted to detect the passing of said partition sheet.

9. An original document feeder according to claim 7, further comprising means for controlling said partition sheet so as to discharge the same from said first sheet path means to the document receiver means through said third sheet path means.

10. An original document feeder according to claim 7, further comprising means for guiding the original document from the first sheet path means to the process unit through the second sheet path means, and then discharging the same from the second sheet path means to the document receiver means through the third sheet path means.

11. An original document feeder according to claim 6, wherein the document feeder B further comprises means defining a sheet path for guiding the original document, discharged from the process unit, not to the second stacker means but to the process unit again with inversion of the document.

12. An original document feeder according to claim 11, further comprising means for advancing the original document from the document feeder A to the document feeder B, when obtaining one- or two-sided copies from two-sided original documents, or when recycling the original document plural times in order to obtain plural copies from an original document.

13. An original document feeder according to claim 6, wherein said original document feeder A and said original document feeder B are constructed and arranged to be at opposite sides of the process unit.

14. An original document handling device comprising:

an original document feeder A including a fist stacker means for stacking original documents, said first stacker means being adapted to receive manually-set original documents; first feed means for one-by-one feeding of the stacked original documents;

means defining a first sheet inlet path for guiding an original document fed by said first feed means to a process unit;

an original document feeder B including second stacker means for stacking original documents, said second stacker means adapted to receive manually-set original documents; second feed means for one-by-one feeding of the stacked original documents; means defining a second sheet inlet path for guiding an original document fed by said second feed means to the process unit; and means defining a sheet back path for guiding the original document discharged from the process unit to said second stacker means; and control means for advancing the original document from said document feeder A to said document feeder B when processing in said document feeder B is to be performed.

15. An original handling device according to claim 14, further comprising feeding means for introducing the original document to a position adjacent a reading means of the process unit, and wherein said document feeder A and said document feeder B are constructed and arranged to be positioned at opposite sides of the process unit.

16. An original document handling device according to claim 14, wherein said process unit comprises a platen glass for reading the original document and includes a reversible conveying belt for conveying the original document, and wherein said original document feeder A is provided at one end of said platen glass and said original document feeder B is provided at an opposite end of said platen glass.

17. An original document handling device according to claim 16, wherein said original document feeder B has a path for reversing a front and a rear surface of the original document.

18. An original document feeder comprising:

stacker means for stacking plural blocks of original documents separated by partition sheets;

feed means for one by one feeding of the stacked original documents;

means defining a first sheet path for guiding an original document fed by said feed means;

means defining a second sheet path for guiding the original document, guided by said first sheet path means, to a process unit;

transport means for positioning adjacent the process unit and capable of reverse operation for discharging the original document, guided from said second sheet path means;

document receiver means for receiving original documents and partition sheets;

means defining a third sheet path for guiding the partition sheet guided by said first sheet path means and the original document discharged by said transport means to the document receiver means;

said second and third sheet path means being branched from said first sheet path means in switchback fashion;

selector means at the junction between the first and second sheet path means and a first reversible roller at the downstream side of the first sheet path means; and said first and third sheet path means being curved downwardly to invert the original document or the partition sheet passing therein;

wherein said stacker means, first sheet path means, second sheet path means, third sheet path means and document receiver means are constructed and arranged to be positioned alongside an entrance to said process unit.

19. An original document feeder according to claim 18, wherein the junction of the first and third sheet path means is positioned downstream of said first reversible roller, and further comprising a second reversible roller positioned further downstream of said junction.

20. An original document feeder comprising:

stacker means for stacking plural blocks of original documents separated by partition sheets;

feed means for one-by-one feeding of the stacked-original sheets and partition sheets;

means defining a sheet feed path for guiding an original document, fed by said feed means, to the entrance of a process unit;

means defining a sheet transport path for guiding the original document from said sheet feed path to a predetermined position of the process unit;

transport means provided in said sheet transport path and capable of reverse operation for discharging the original document, guided from said entrance, back through said entrance;

means defining a sheet discharge path for guiding the partition sheet guided from said sheet path and the original document discharged by said transport means, wherein said defining means branches from an intermediate portion of the sheet feed path;

document receiver means for receiving the partition sheet and the original document guided through said sheet discharge path, said original document being reversed by said transport means in the process of being discharged;

means for detecting a partition sheet between plural blocks or original documents, for the purpose of switching copying modes, wherein said partition detecting means comprises a sensor provided in said sheet feed path and adapted to detect the passing of the partition sheet; and means for controlling said partition sheet so as to discharge the same from the sheet feed path means to the document receiver means through the sheet discharge path means, wherein said stacker means, sheet feed path means, sheet transport path means, sheet discharge path means and document receiver means are constructed and arranged to be positioned alongside an entrance to said process unit.

21. An original document handling device, comprising:

an original document feeder B including a first stacker means for stacking original documents, said first stacker means being adapted to receive manually-set original documents; first feed means for one-by-one feeding of the stacked original documents; means defining a sheet inlet path for guiding an original document fed by said first feed means; a reversely rotatable conveying belt for positioning the original document guided through said sheet inlet path to a reading position; and means for defining a sheet back path for guiding the original document discharged from the reading position to said first stacker means;

an original document feeder A disposed at an opposite side of said conveying belt with respect to original document feeder B and including second stacker means for stacking original documents, said second stacker means being adapted to receive manually-set original documents, second feed means for one-by-one feeding of the stacked original documents fed by said second feed means to said conveying belt; and control means for advancing the original document from said original document feeder A to said original document feeder B when processing in said original document feeder B is to be performed.

22. An original document handling device according to claim 21, wherein said original document feeder B has a path for reversing the front and back surfaces of the original document.

23. An original handling device, comprising:

an original document feeder B not having a reserve function for reserving a sequence of plural sheet bundles and including first stacker means for stacking original documents, said first stacker means adapted to receive manually-set original documents; first feed means for one-by-one feeding of the stacked original documents; means for defining a first sheet inlet path for guiding an original document fed by said first feeding means to a reading position; and means for defining a sheet inversion path for guiding the original document discharged from the reading position to the reading position again with inversion of the document; and an original document feeder A having a reserve function for reserving a reading sequence of plural sheet bundles and including second stacker means for stacking original documents, said second stacker means being adapted to receive manually-set original documents; second feed means for one-by-one feeding of the stacked original documents; and means for defining a second sheet inlet path for guiding an original document fed by said second feed means to said original document feeder B.

24. An original document handling device, comprising:

an original document feeder B including a first stacker means for stacking original documents, said first stacker means being adapted to receive manually-set original documents; first feed means for one-by-one feeding of the stacked original documents; means defining a sheet inlet path for guiding an original document fed by said first feed means to a process unit; and means for defining a first sheet back path for guiding the original document discharged from the process unit to said first stacker means;

an original document feeder A including second stacker means for stacking original documents, said second stacker means being adapted to receive manually-set original documents; second feed means for one-by-one feeding of the stacked original documents; means defining a second sheet inlet path for guiding an original document fed by said second feed means to said original document feeder B; and control means for advancing the original document from said original document feeder A to said original document feeder B when processing in said original document feeder B is to be performed.

25. An original document handling device, comprising:

an original document feeder B including first stacker means for stacking original documents, said first stacker means being adapted to receive manually-set original documents; first feed means for one-by-one feeding of the stacked original documents; means defining a first sheet inlet path for guiding an original document fed by said first feed means; a reversibly rotatable conveying belt for positioning the original document guided through said first sheet inlet path to a reading position; and means for defining a first sheet back path for guiding the original document discharged from the reading position to said first stacker means;

an original document feeder A disposed at an opposite side of said conveying belt with respect to original document feeder B and including second stacker means for stacking original documents, said second stacker means being adapted to receive manually-set original documents; second feed means for one-by-one feeding of the stacked original documents, means defining a second sheet inlet path for guiding an original document fed by said second feed means to said original document feeder B; and control means for advancing the original document from said second document feeder to said first document feeder when processing in said original document feeder B is to be performed.

26. An original handling device, comprising:

an original document feeder B not having a reserve function for reserving sequence of plural sheet bundles and including first stacker means for stacking original documents, said first stacker means adapted to receive manually-set original documents; first feed means for one-by-one feeding of the stacked original documents; means for defining a first sheet inlet path for guiding an original document fed by said first feeding means to a reading position; and means for defining a first sheet back path for guiding the original document discharged from the reading position; and an original document feeder A having a reserve function for reserving a reading sequence of plural sheet bundles and including second stacker means for stacking original documents, said second stacker means being adapted to receive manually-set original documents; second feed means for one-by-one feeding of the stacked original documents; means for defining a second sheet inlet path for guiding an original document fed by said second feed means to said original document feeder B.

27. An original document handling device according to claim 26, wherein said original document feeder A and said original document feeder B are disposed at opposite sides of said reading position.

28. An original document handling device according to claim 26, wherein said original document feeder B is a recyclic document feed.

29. An original document handling device according to claim 28, further including a both-surface path.

30. An original document handling device comprising:

an original document feeder A including a first stacker means for stacking original documents, said first stacker means being adapted to receive manually-set original documents; first feed means for one-by-one feeding of the stacked original documents; and means defining a first sheet inlet path for guiding an original document fed by said first feed means to a process unit;

an original document feeder B including second stacker means for stacking original documents, said second stacker means adapted to receive manually-set original documents; second feed means for one-by-one feeding of the stacked original documents; means defining a second sheet inlet path for guiding an original document fed by said second feed means to the process unit; and means defining a sheet inversion path for guiding the original document discharged from the process unit to the process unit again with inversion of the document; and control means for advancing the original document from said document feeder A to said document feeder B when processing in said document feeder B is to be performed.

31. An original document handling device, comprising:

an original document feeder B including a first stacker means for stacking original documents, said first stacker means being adapted to receive manually-set original documents; first feed means for one-by-one feeding of the stacked original documents; means defining a sheet inlet path for guiding an original document fed by said first feed means to a process unit; and means for defining a sheet inversion path for guiding the original document discharged from the process unit to the process unit again with inversion of the document;

an original document feeder A including second stacker means for stacking original documents, said second stacker means being adapted to receive manually-set original documents; second feed means for one-by-one feeding of the stacked original documents; and means defining a second sheet inlet path for guiding an original document fed by said second feed means to said original document feeder B; and control means for advancing the original document from said original document feeder A to said original document feeder B when processing in said original document feeder B is to be performed.

* * * * *

UNITED STATES PATENT AND TRADEMARK OFFICE

CERTIFICATE OF CORRECTION

PATENT NO. : 5,156,386 Page 1 of 2

DATED : October 20, 1992

INVENTOR(S) : TADAYUKI KITAJIMA, ET AL.

It is certified that error appears in the above-identified patent and that said Letters Patent is hereby corrected as shown below:

Title page, item

[57] ABSTRACT

"32 claims," should read --31 claims,--.
"invention document" should read --original document--.

COLUMN 4

Line 20, "ensure" should read --ensures--.

COLUMN 5

Line 47, "continue" should read --continues--.

COLUMN 8

Line 14, "sheet:" should read --sheet--.

COLUMN 12

Line 31, "(1)" should read --(ℓ)--.
Line 32, "(1)" should read --(ℓ)--.

COLUMN 13

Line 33, "documents-stacked" should read --documents stacked--.

COLUMN 14

Line 13, "(1)" should read --(ℓ)--.

COLUMN 16

Line 7, "(1)" should read --(ℓ)--.
Line 61, "00-02" should read --00-02--.

UNITED STATES PATENT AND TRADEMARK OFFICE

CERTIFICATE OF CORRECTION

PATENT NO. : 5,156,386 Page 2 of 2

DATED : October 20, 1992

INVENTOR(S) : TADAYUKI KITAJIMA, ET AL.

It is certified that error appears in the above-identified patent and that said Letters Patent is hereby corrected as shown below:

COLUMN 17
Line 54, "path." should read --path means.--.

COLUMN 18
Line 64, "fist" should read --first--.

COLUMN 21
Line 4, "fed by said second feed means" should be deleted.

COLUMN 22
Line 18, a new paragraph should begin after "documents;" and before "means".

Signed and Sealed this

First Day of February, 1994

Bruce Lehman

*Attest:*

BRUCE LEHMAN

*Attesting Officer*

*Commissioner of Patents and Trademarks*